US005791160A

United States Patent [19]

Mandler et al.

[11] Patent Number: 5,791,160

[45] Date of Patent: Aug. 11, 1998

[54] METHOD AND APPARATUS FOR REGULATORY CONTROL OF PRODUCTION AND TEMPERATURE IN A MIXED REFRIGERANT LIQUEFIED NATURAL GAS FACILITY

[75] Inventors: Jorge Anibal Mandler, Fogelsville; Philip Albert Brochu, Allentown; James Robert Hamilton, Jr., Macungie, all of Pa.

[73] Assignee: Air Products and Chemicals, Inc., Allentown, Pa.

[21] Appl. No.: 899,899

[22] Filed: Jul. 24, 1997

[51] Int. Cl.[6] ..... F25J 1/00

[52] U.S. Cl. ..... 62/611; 62/657

[58] Field of Search ..... 62/628, 657, 611

[56] References Cited

U.S. PATENT DOCUMENTS

| | | | |
|---|---|---|---|
| 3,763,658 | 10/1973 | Gaumer, Jr. et al. | 62/40 |
| 4,746,407 | 5/1988 | Olson | 62/628 |
| 4,809,154 | 2/1989 | Newton | 364/148 |
| 5,139,548 | 8/1992 | Liu et al. | 62/24 |
| 5,473,900 | 12/1995 | Low | 62/611 |

OTHER PUBLICATIONS

"Use of plate fin heat exchangers for main cryogenic exchanger units" by M. Onaka, K. Asada, & K. Mitsuhashi, LNG Journal, pp. 17–19, Jan.–Feb., 1997.

*Primary Examiner*—Ronald C. Capossela
*Attorney, Agent, or Firm*—Thomas G. Ryder

[57] ABSTRACT

A control system for a process of liquefied natural gas production (LNG) from natural gas using a heat exchanger and a closed loop refrigeration cycle employs independent, direct control of both production and temperature by adjusting refrigeration to match a set production. The control system sets and controls LNG production at a required production value, and independently controls LNG temperature by adjusting the refrigeration provided to the natural gas stream. One exemplary method employs compressor speed, for example, as a key manipulated variable (MV) to achieve fast and stable LNG temperature regulation. Other compressor variables rather than speed may be key MVs, depending on the type of MR compressors employed, and may be the guidevane angle in a centrifugal compressor or the stator blade angle in an axial compressor. The second exemplary method employs a ratio of total recirculating refrigerant flow to LNG flow as the key manipulated variable to effectively control the LNG temperature.

46 Claims, 10 Drawing Sheets

METHOD AND APPARATUS FOR REGULATORY CONTROL OF PRODUCTION AND TEMPERATURE IN A MIXED REFRIGERANT LIQUEFIED NATURAL GAS FACILITY

CROSS-REFERENCE TO RELATED APPLICATIONS

Not applicable

STATEMENT REGARDING FEDERALLY SPONSORED RESEARCH OR DEVELOPMENT

Not applicable

FIELD OF THE INVENTION

This invention relates to the field of control systems for production of liquefied natural gas (LNG), and more specifically, to a process and system which controls LNG production and LNG temperature.

BACKGROUND OF THE INVENTION

Systems for the liquefaction of natural gas using a multicomponent refrigerant are in use throughout the world. Multicomponent refrigerant process and cryogenic equipment are used throughout the industry, and control of the LNG production process is important to operate a plant efficiently, especially when attempting to extract incremental production from a fixed plant or when attempting to adjust to external process disturbances. Many baseload LNG plants in the world employing a mixed refrigerant process are manually controlled or controlled to satisfy only a subset of the key control objectives.

Simultaneous and independent control of both LNG production rate and temperature is important for LNG plant operation. By fixing and maintaining the LNG production rate, plant operators can adequately plan and achieve desired production levels as required by the product shipping schedule. Maintaining the temperature of the LNG exiting the main cryogenic heat exchanger within a specified range is important for downstream processing and the prevention of downstream equipment problems. Once regulatory control is achieved for the key variables, optimization strategies can be properly implemented. However, if regulatory control is not adequate, even standard day to day operation is adversely affected.

One control system of the prior art is based on the strategy of U.S. Pat. No. 4,809,154, entitled AUTOMATED CONTROL SYSTEM FOR A MULTICOMPONENT REFRIGERATION SYSTEM, issued Feb. 28, 1989 to Charles Newton and incorporated herein by reference, to control the main cryogenic heat exchanger/mixed refrigerant loop system. The recommended control strategy in U.S. Pat. No. 4,809,154 has as its objective to achieve the highest production per unit of energy consumed. The refrigeration capacity is determined by setting the speed of low pressure and high pressure multicomponent, or mixed, refrigerant (MR) compressors, and by adjusting the total inventory and composition of the MR with the MR makeup valves and the high pressure separator vent and drain valves. Compressor speed, makeup valves, and vent and drain valves are adjusted by the operators as required, but they are not part of the automatic regulatory control strategy. The regulatory control strategy consists of three main feedback loops. A cold JT valve is adjusted for feedback control of the pressure ratio across the MR compressors. A warm JT valve is adjusted for feedback control of the ratio of heavy (mixed refrigerant liquid or MRL) to light (mixed refrigerant vapor or MRV) MR. Control of the LNG offtake temperature is done by means of the LNG offtake valve(s).

FIG. 10 is a schematic flow diagram of a mixed refrigerant liquefied natural gas plant 40, and also indicates the placement of sensors, for a cascade control system of the prior art. As shown in FIG. 10, the MR LNG plant 40 includes an input feed of natural gas at line 10 flowing through valve 12 to a heat exchanger 14. After cooling in heat exchanger 14, LNG is provided at line 11 as an outlet stream from Joule-Thomson (JT) LNG offtake valve 30. Natural gas is cooled in heat exchanger 14 by a heat exchange process employing a closed loop refrigeration cycle with MR. MR includes a vapor component MRV and a liquid component MRL. The process for liquefaction in an LNG plant and the elements of the LNG plant to implement this process are well known and described in detail U.S. Pat. No. 3,763,658, entitled COMBINED CASCADE AND MULTICOMPONENT REFRIGERATION SYSTEM AND METHOD, issued Oct. 9, 1973 to Lee S. Gaumer, Jr. et al. which is incorporated herein by reference.

The natural gas provided to the heat exchanger 14 through line 10 may be processed first by separation and treating processes including at least one single component refrigeration cycle before being provided to the multicomponent refrigeration portion of the liquefaction process. In this first processing, natural gas from a source may be provided at a pressure of between 28 $kg/cm^2a$ and 70 $kg/cm^2a$, with approximately 49 $kg/cm^2a$ being a typical value. This pressure is determined by the system requirements for separation of heavy hydrocarbons, impurities, water, or other undesirable compounds. The natural gas is then cooled to a first temperature, which is typically about ambient temperature (21 degrees centigrade) by first single component heat exchange process. Upon cooling of the natural gas, a phase separator is used to remove condensed water, and then the natural gas stream is fed to one or more driers to remove additional moisture.

The dried natural gas stream is then further cooled to a temperature of approximately −1 degrees centigrade in a second heat exchange process and then supplied to scrubbers, or other similar units, to remove benzene and other heavy hydrocarbons. The natural gas stream from the scrubbers is then cooled further in a third heat exchange process to approximately −35 degrees centigrade, and is then supplied to the two zone heat exchanger 14 employing a multicomponent refrigeration cycle.

Referring to FIG. 10, the liquefaction process occurs as the natural gas flows through a two zone heat exchanger 14. Natural gas from the separation and treating process enters two zone heat exchanger 14 from feed line 10 and passes upwardly through tube circuit 114 from intake valve 12 at a warm bundle 110 of the heat exchanger 14. The natural gas in tube circuit 114 is cooled by a counter flow of MR sprayed downwardly over the tube circuit by spray header 124. The natural gas flows in tube circuit 114 which is contained in warm bundle 110, which is the first zone, within heat exchanger shell 122. The natural gas feed stream passes into cold bundle 112, which is the second zone, and passes upwardly through tube circuit 115 which is cooled by a second counter flow of MR flowing from spray header 126.

The MR, which may a be mixture consisting of nitrogen, methane, ethane and propane, is employed to provide refrigeration within the shell 122 of heat exchanger 114. As is known, MR may be provided as a liquid and as a vapor within the heat exchanger 14. Heat exchange between the natural gas and the MR is efficiently done by vaporization of MR on the shell side of the heat exchange.

The multicomponent closed refrigeration cycle portion of the liquefaction process includes two compressor stages, a low pressure compressor stage 34 and a high pressure compressor stage 32. The low pressure compressor stage 34 receives the MR from the heat exchanger 14, compresses the MR and then passes the compressed MR to high pressure compressor stage 32. The low pressure compressor stage may include a heat exchange process provided by, for example, an aftercooler. The high pressure compressor stage 32 compresses and provides the MR at the desired pressure, and may also provide some local heat exchange process through an aftercooler. The compressed MR from the low pressure compressor stage 34 is typically about 3.2 kg/cm$^2$a, and the compressed MR from the high pressure compressor stage 32 is typically about 49 kg/cm$^2$a and provided at a temperature of approximately 77 degrees centigrade.

The compressed MR from the high pressure compressor stage 32 is passed to another heat exchange process with one or more single component, heat exchangers 128. Typically, propane is used as the single component refrigerant. The MR at 49 kg/cm$^2$a is typically cooled to −35 degrees centigrade by the heat exchange process, but the pressure and temperature used in an LNG plant varies and is dependent upon the desired ratio of MRL to MRV for the system.

The compressed and cooled MR from the heat exchanger 128 is then provided to the separator 42, which separates the MR into the MRV flow at line 13 and MRL flow at line 15. Next, the MR must be pre-cooled to a temperature substantially below the freezing point of water, and preferably to a temperature in the order of −18 to −73 degrees centigrade. Consequently, the MRL from separator 42 on line 15 is passed through the warm bundle 10 of heat exchanger 14 to refrigerate the MRL in tube circuit 118. The flow rate of the MRL from tube circuit 118 to spray header 124 may be adjusted by Warm JT valve 18. MRV from separator 42 on line 13 is also provided to warm bundle 110 of heat exchanger 14 to refrigerate the MRV in tube circuit 116. MRV is then provided to the cold bundle 112 in tube circuit 117, and the flow rate of the MRV from tube circuit 117 to spray header 126 may be adjusted by Cold JT valve 16. Cooling of the MRV and MRL in the tube circuits is accomplished in a similar manner to that of the natural gas stream in tube circuits 114 and 115 described previously using counterflowing MR.

MRL in tube circuit 118 is subcooled in heat exchanger 14 to a temperature in the order of −112 degrees centigrade, and the subcooled MRL is expanded in Warm JT valve 18 to a pressure in the order of 3.5 kg/cm$^2$a, whereby a portion flashes to vapor and its temperature drops to approximately −118 degrees centigrade. The liquid and flashed vapor are then injected into the warm bundle 110 through spray header 124.

MRV in tube circuit 116 is also subcooled in heat exchanger 14 where it is condensed, and then provided to second tube circuit 117 in cold bundle 112 wherein the condensed MRV is subcooled to approximately −168 degrees centigrade. This subcooled liquid fraction is expanded in Cold JT valve 16 to a pressure in the order of 3.5 kg/cm$^2$a, whereby a portion flashes to vapor. The liquid fraction and flashed vapor are then injected into the cold bundle 112 through spray header 126.

In flowing downwardly over the tube circuits, the MR is vaporized in heat exchange with the natural gas feed stream, as well as in heat exchange with the MRL and MRV flowing upward in the heat exchanger 14. As a result, all the MRL and liquid fraction are recombined in vapor phase at the bottom of the heat exchanger 14, and the vapor is returned to the suction side of low pressure compressor stage 34. MR is returned to the compressors 32 and 34 for compression, and subsequent cooling and separation, through line 120.

The refrigeration capacity may be determined by setting the speed of the low pressure and high pressure mixed refrigerant (MR) compressor stages 34 and 32, and by adjusting the total inventory and composition of the MR with MR makeup valves 100, 101, 102 and 103; and high pressure separator vent and drain valves (not shown). Compressor speed, makeup valve positions, and vent and drain valves are adjusted by the operators as required.

There are three feedback loops of the prior art.

The first feedback loop of the prior art controls LNG offtake temperature by cascade control employing a Temperature Indicator Controller (TIC) 26 and Flow Indicator Controller (FIC) 28. The temperature of the LNG output stream from the heat exchanger 14 is measured and compared to a setpoint value SP1 by TIC 26 to provide a desired flow control signal to adjust present temperature to desired temperature. FIC 28 measures the present LNG flow and compares this to the desired flow signal from TIC 26, and adjusts the LNG offtake valve(s) 30 accordingly.

In the second feedback loop, the Warm JT valve 18 is adjusted for feedback control of the ratio of heavy (mixed refrigerant liquid or MRL) to light (mixed refrigerant vapor or MRV) MR. The Warm JT valve 18 is adjusted by a Flow Ratio Controller (FRC) 22 which compares the MR flow ratio of MRL to MRV (as measured by Flow Indicators 20), and the MRL/MRV ratio calculated by divider 24 to a setpoint value (SP2) determined offline.

In the third feedback loop, the Cold JT valve 16 is adjusted for feedback control of the pressure ratio across the MR compressor stages 32 and 34 by a Compression Ratio Controller (CRC) 39. CRC 39 produces the feedback signal using a setpoint value SP3 also determined offline, and the compressor pressures are read by Pressure Indicators (PIs) 38.

By changing the position of LNG offtake valve 30 to regulate the LNG temperature, the LNG product flow is directly affected, and therefore independent regulation of both flow and temperature at their desired setpoints is not possible with this scheme. The LNG production is left to "float" and the desired production rate is attained in an indirect fashion. Changing the flow ratio control signal of FRC 22 or compression ratio control signal of CRC 39 by changing setpoints SP2, SP3, or by operators changing the compressor speed, MR composition, or inventory sets refrigeration capacity. In order to maintain production temperature within a desired range, the TIC 26 lets the LNG production float to match the refrigeration provided.

Recent attempts to improve the control of the baseload LNG process have maintained the control strategy of U.S. Pat. No. 4,809,154 as the underlying scheme. U.S. Pat. No. 5,139,548, for example, discloses a feedforward control scheme to adjust for ambient air temperature changes, that is superimposed on the old scheme.

BRIEF SUMMARY OF THE INVENTION

A method and apparatus for controlling production of a liquefied natural gas (LNG) outlet stream by refrigeration of the natural gas flowing through a liquefaction process which: (a) measures a temperature and a flow rate of the LNG outlet stream; (b) varies the refrigeration of the natural gas to adjust the temperature value of the LNG outlet stream and (c) independently adjusts the flow rate of the LNG flowing through the process. In this way, there is maintained the flow rate of the LNG outlet stream at a predetermined flow value and the temperature at a predetermined temperature value.

A further embodiment includes varying a value associated with a compressor providing the refrigeration to adjust the temperature value of the LNG outlet stream.

Another embodiment includes varying a value of mixed refrigerant (MR) providing the refrigeration to adjust the temperature value of the LNG outlet stream.

BRIEF DESCRIPTION OF THE SEVERAL VIEWS OF THE DRAWINGS

These and other features and advantages of the present invention will become apparent from the following detailed description, taken in conjunction with the accompanying drawings, wherein.

DETAILED DESCRIPTION OF THE INVENTION

Process Overview

Figure 1:
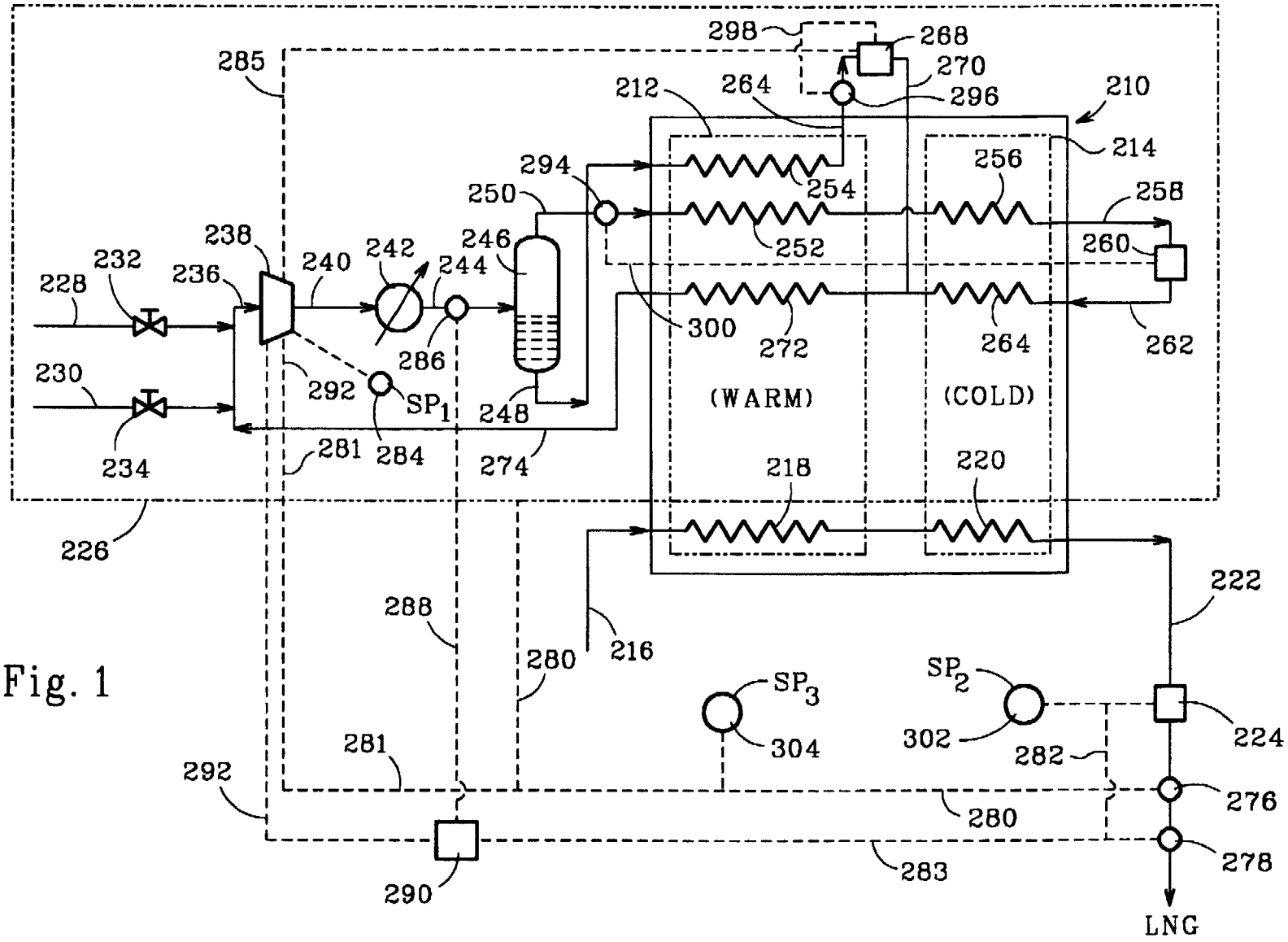
FIG. 1 is a schematic flow diagram of a typical mixed refrigerant liquefied natural gas plant process of an exemplary embodiment of the present invention.

In FIG. 1 there is shown a two zone heat exchanger 210 comprising a warm zone 212 and a cold zone 214, each of which is outlined by dashed lines in FIG. 1. The heat exchanger can be any of the types well known in the art which permit of indirect heat exchange between two fluid streams. Such heat exchangers can be plate and fin heat exchangers, tube and shell heat exchangers, including coil wound tube heat exchangers, or any other similar devices permitting indirect heat exchange between fluids, such as a natural gas stream and a refrigerant stream. The flow of natural gas through the heat exchanger can be upwardly, downwardly or even horizontally. Thus, while the flow through heat exchanger 210 is illustrated in FIG. 1 as being horizontal, this should not be taken as a process limitation, since the flow could be vertical and either upward or downward, generally dependent upon the particular type heat exchanger selected.

In the scheme of FIG. 1, natural gas is introduced into heat exchanger 210 via natural gas inlet line 216 and the natural gas passes through the warm zone 212 via heat exchange path 218 and thence through the cold zone 214 via heat exchange path 220 and, finally, liquefied natural gas (LNG) is removed from heat exchanger 210 via LNG outlet line 222, which contains a flow control or pressure reduction device 224. This flow control or pressure reduction device can be any device suitable for controlling flow and/or reducing pressure in the line and can be, for instance, in the form of a turbo expander, a J-T valve or a combination of both, such as, for example, a J-T valve and a turbo expander in parallel, which provides the capability of using either or both the J-T valve and the turbo expander simultaneously.

Also shown in FIG. 1 is a closed loop refrigeration cycle 226, which is also outlined by dashed lines. As illustrated in FIG. 1, basically this closed loop refrigeration cycle comprises refrigerant component inlet lines 228 and 230 to introduce into the refrigeration loop different components of a multi-component or mixed refrigerant. While in FIG. 1 only two separate refrigerant component inlet lines are shown, it will be understood by those skilled in the art that, in practice, the multi-component or mixed refrigerant can be comprised of three, four or even five different components, but that for purposes of illustration in the present figure, only two are shown. Refrigerant component inlet lines 228 and 230 each contain valves 232 and 234, respectively, to control the amount of individual components being introduced into the refrigeration loop. The multi-component or mixed refrigerant is introduced via mixed refrigerant (MR) inlet line 236 to compressor 238. The compressed MR from compressor 238 is passed by means of line 240 into cooler 242 wherein the compressed MR is cooled sufficiently to effect at least partial condensation thereof. Cooler 242 can be any of the types well known in the art and the compressed MR gas can be cooled against various materials including water, refrigerated water and other hydrocarbons such as heavier hydrocarbons including, for example, propane. While single compression and cooling stages (238 and 242) have been shown, it will be understood by those skilled in the art that multiple compression stages with interstage cooling can readily be employed in this situation. For ease of illustration, only single compression and cooling stages have been shown.

The partially condensed MR is passed via line 244 into separator 246 wherein it is separated into liquid and vapor phases. The liquid phase of the MR (MRL) is withdrawn from separator 246 by means of line 248 and is introduced into the warm zone 212 of heat exchanger 210. The vapor phase of the MR (MRV) is removed from separator 246 by means of line 250 and is also introduced into the warm zone 212 of heat exchanger 210. As illustrated in this Figure, the MRV flows through warm zone 212 via heat exchange path 252 cocurrent to the flow of natural gas in heat exchange path 218, also in the warm zone 212. It will be understood, of course, that it is also possible for the flow to be countercurrent in other conformations of a heat exchanger. Similarly, the MRL flows through heat exchange path 254 in the warm zone 212, also cocurrent to the flow of natural gas through heat exchange path 218 in the warm zone of heat exchanger 210. The MRV continues to flow through heat exchanger path 256 in the cold end 214 of heat exchanger 210 cocurrent to the flow of natural gas through heat exchanger path 220 in the cold zone 214 of heat exchanger 210.

The MRV is then withdrawn from heat exchanger 210 by means of line 258 and is passed through flow control or pressure reduction device 260 wherein the pressure of the mixed refrigerant of line 258 is reduced resulting in a reduction in temperature of the MRV. Again, device 260 can be any device suitable for controlling flow and/or reducing pressure in the line and can be, for instance, in the form of a turbo expander, a J-T valve or a combination of both, such as, for example, a J-T valve and a turbo expander in parallel, which provides the capability of using either or both the J-T valve and the turbo expander simultaneously. The reduced temperature MRV, after leaving device 260 is now reintroduced into heat exchanger 210 via line 262 and is passed through heat exchange path 264 in the cold end 214 of heat exchanger 210. The flow through heat exchange path 264 is countercurrent to the flow of mixed refrigerant vapor in heat exchange path 256 and natural gas flow in heat exchange path 220.

After having passed through heat exchange path 254 in the warm end 212 of heat exchanger 210, the MRL is withdrawn from heat exchanger 210 by means of line 264 and passed to flow control/pressure reduction device 268 wherein the pressure of the mixed refrigerant liquid is reduced thereby effecting a reduction in temperature of this material. As mentioned above, device 268 can be any device suitable for controlling flow and/or reducing pressure in the line and can be, for instance, in the form of a turbo expander, a J-T valve or a combination of both, such as, for example, a J-T valve and a turbo expander in parallel, which provides the capability of using either or both the J-T valve and the turbo expander simultaneously. The reduced temperature MRL, after leaving device 268, is then reintroduced into heat exchanger 210 by means of line 270 and is combined with the MRV stream leaving heat exchange path 264 and the combined streams from line 270 and heat exchange path 264 are passed through heat exchange path 272 which is in indirect heat exchange relationship with heat exchange paths 218, 252, and 254 in the warm zone 212 of heat exchanger 210 and the combined streams flow through the warm zone 212 in countercurrent flow relative to the flow of natural gas through heat exchange path 218 and the flow of MR through heat exchange paths 252 and 254. Typically, the combined mixed refrigerant stream passing through heat exchange path 272 is totally vaporized by the time it reaches the end of heat exchange path 272 and the vaporized mixed refrigerant is removed from heat exchanger 210 by means of line 274 and recycled to compressor 238 within the closed loop refrigeration cycle 226.

Similarly, heat exchange paths 220, 256 and 264 in the cold zone of heat exchanger 210 are also in indirect heat exchange relationship which each other.

Also shown in FIG. 1 is a temperature sensing device 276 associated with line 222 to measure the temperature of the liquefied natural gas stream flowing in line 222. Similarly, there is associated with line 222 a flow sensing device 278 to measure the flow of liquefied natural gas in line 222. The temperature sensing device 276 generates a signal responsive to the temperature of the LNG in line 222 which is used to control the closed loop refrigeration cycle 226 as indicated by dotted line 280 extending from temperature sensing device 276 to the dashed line about closed loop refrigeration cycle 226. The flow sensing device 278 also generates a signal responsive to the flow of LNG in line 222 and this signal is passed to flow control device 224 as indicated by line 282. Generally, in this manner through the measurement of the temperature and flow rate in the LNG outlet stream, the refrigeration of the natural gas can be controlled to adjust the temperature of the LNG outlet stream, while the flow rate of the LNG outlet stream is independently controlled thereby maintaining the flow rate and temperature of the LNG outlet stream at desired levels.

In a more specific illustration of this invention, the signal of line 280 is shown to be transmitted to compressor 238, as indicated by the extension of dotted line 280 and indicated by reference numeral 281, in order to vary a value associated with the compressor providing the refrigeration and thereby adjusting the temperature value of the LNG outlet stream of line 222. More specifically, in such a configuration where the compressor 238 adjusts the flow and pressure of the refrigerant in closed loop refrigeration cycle 226, the compressor value which is varied can be any one or more of compressor speed, guidevane angle or stator blade position, which function(s) to adjust the temperature value to the LNG outlet stream of line 222.

Additionally, a predetermined target value based on the constraints defining one of the operating ranges of compressor 238 can be established as indicated by set point 1 device 284 associated with compressor 238 and this particular compressor value can be adjusted to the corresponding set point. Based upon the adjustment to the selected value of compressor 238, a value associated with the recirculation of refrigerant in closed loop cycle 226, for example, the flow control or pressure reduction device 268, can be varied. This is indicated by dotted line 285 coming from compressor 238 to flow control/pressure reduction device 268.

Further, the flow rate of the refrigerant within the closed loop refrigeration cycle 226 can be measured, for example by utilizing a flow sensing device 286 to measure the flow of refrigerant in line 244 to generate a signal responsive to the refrigerant flow rate and feeding this signal as indicated by dotted line 288 to ratio calculator 290. A signal representing the flow rate of LNG in line 222 is also fed to ratio calculator 290 by means of the extension of line 282, as indicated by dotted line 283. The ratio so formed is adjusted so as to control the operation of the closed loop refrigeration cycle to adjust the temperature value of the LNG outlet stream in line 222. The ratio signal from the device is indicated as line 292 running from ratio calculator 290 to closed loop refrigeration cycle 226.

More particularly, when, as shown in FIG. 1, the refrigerant within the closed loop refrigerant cycle 226 is partially condensed to form a refrigerant liquid and a refrigerant vapor, the flow rate of the refrigerant vapor is measured by a flow sensing device 294 associated with line 250, while the flow rate of the liquid refrigerant stream is measured by flow sensing device 296 associated with line 264. In an operation such as this, a signal representative of the flow rate of the liquid refrigerant is generated by flow sensing device 296 and is transmitted to flow control device 268 as indicated by dotted line 298. Similarly, a signal representative of the vapor refrigerant flow rate generated by flow sensing device 294 is transmitted to flow control device 260 as indicated by dotted line 300. In this way, the flow of the liquid refrigerant can be adjusted to control the ratio of the flow of liquid refrigerant to the flow of vapor refrigerant. Simultaneously, the flow of the vapor refrigerant can be adjusted to control the total flow of refrigerant. Through such an operation, the adjustment of the vapor refrigerant flow results in an adjustment of the overall ratio of refrigerant to LNG flow rate. When mechanical restraints are reached in the control of the liquid and vapor refrigerant flow, a value of the compressor 238 in closed loop refrigeration cycle 226 is varied further to adjust the temperature value of the LNG outlet stream. This is indicated in FIG. 1 by the extension of line 292 coming from ratio calculator 290 to compressor 238.

In a preferred mode of operation, the signal generated by flow sensing device 278 and transmitted to flow control/pressure reduction device 224, as indicated by line 282, can be compared to a predetermined value as indicated by set point 2 device 302 and the flow rate in line 222 can be adjusted by means of device 224 in order to make it conform to the predetermined value shown in set point 2 device 302. Similarly, the signal representative of the temperature of the LNG in line 222 is generated by temperature sensing device 276 can also be compared to a predetermined value as indicated by set point 3 device 304 associated with line 280. This can be utilized to adjust the refrigeration provided by closed loop refrigerant cycle 226 or in a particularly embodiment to control one of the variables of compressor 238 thereby to control the temperature of the outlet stream in line 222.

Consequently, in the present invention, LNG temperature is controlled by adjusting the refrigeration, while LNG production is controlled independently. The LNG production is set in a direct fashion, and the refrigeration is adjusted to match the refrigeration requirements at a given LNG temperature and production. This is an opposite approach to that of the prior art. The steps comprise: (a) measuring a temperature and flow rate of the LNG outlet stream at line 11; and (b) varying the refrigeration of the natural gas by vaporization of MR, to adjust the temperature value of the LNG outlet stream at line 11, and (c) adjusting, by LNG offtake valve 30, the rate of the LNG flowing through the liquefaction process from the cold bundle 112 of the heat exchanger 14, thereby, in this way, there is maintained the flow rate and temperature of the LNG outlet stream at predetermined flow value and temperature value setpoints.

In this process, the exemplary embodiments of the present invention include a control system which sets and maintains LNG production at a required production value, and controls LNG temperature by adjusting the refrigeration provided to the natural gas stream (thereby matching the refrigeration to the required production, as opposed to matching the production to the available refrigeration as done in the prior art).

An exemplary first embodiment of the present invention includes varying a value associated with each compressor 32 and 34 compressing the MR received from the warm bundle 110 in line 120 of the heat exchanger 14, to adjust the temperature value of the LNG outlet stream at line 11.

The embodiment may employ compressor speed of compressors 32 and 34, for example, as a key manipulated variable (MV) to achieve fast and stable LNG temperature regulation. Other compressor variables rather than speed may be key MVs, depending on the type of MR compressors employed, and may be the guidevane angle in a centrifugal compressor or the stator blade angle in an axial compressor.

A further exemplary embodiment includes varying a mixed refrigerant (MR) value, such as a flow, composition or pressure of the MRV and/or MRL, flowing from headers 124 and 126, to adjust the temperature value of the LNG outlet stream at line 11. The second exemplary embodiment employs a ratio of total recirculating refrigerant flow to LNG flow as the key manipulated variable to effectively control the LNG temperature.

Although the described embodiments of the liquefaction process include aspects of the coil wound implementation of a two zone heat exchanger in which the natural gas feed stream is passed from the bottom to the top of the heat exchanger unit, the described embodiments are equally applicable to other types of heat exchangers, such as plate fin heat exchangers mentioned previously. For example, the structure and use of the plate fin heat exchanger is described in "Use of plate fin heat exchangers for main cryogenic exchanger units," by M. Onaka, K. Asada, and K. Mitsuhashi, LNG Journal, pp17–19, January-February, 1997, which is incorporated herein by reference for its description of the plate fin heat exchanger and accompanying process.

Compressor Speed-Based Control System

Figure 3:
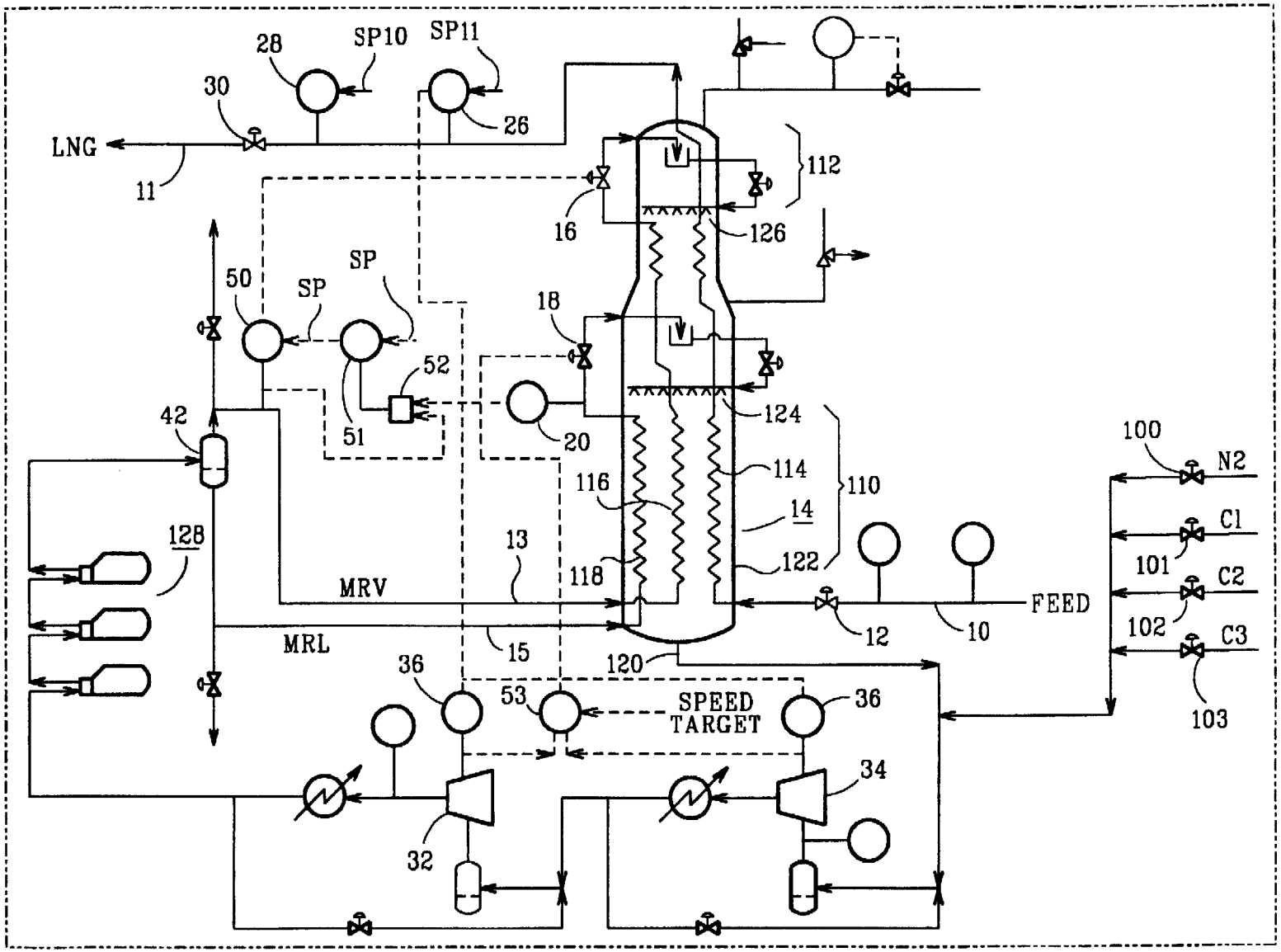
FIG. 3 is a schematic flow diagram of a typical mixed refrigerant liquefied natural gas plant indicating the placement of sensors for a speed-based control system as illustrated in FIG. 2.

The first exemplary embodiment of the present invention used in an LNG plant 40A, shown in FIG. 3, employs a control system based on feedback control of LNG flow rate, and independent feedback control of the temperature of the LNG production by adjusting compressor speed, and additionally adjusting mixed refrigerant flow to return the compressor speed to a value within a desired operating range.

Figure 2:
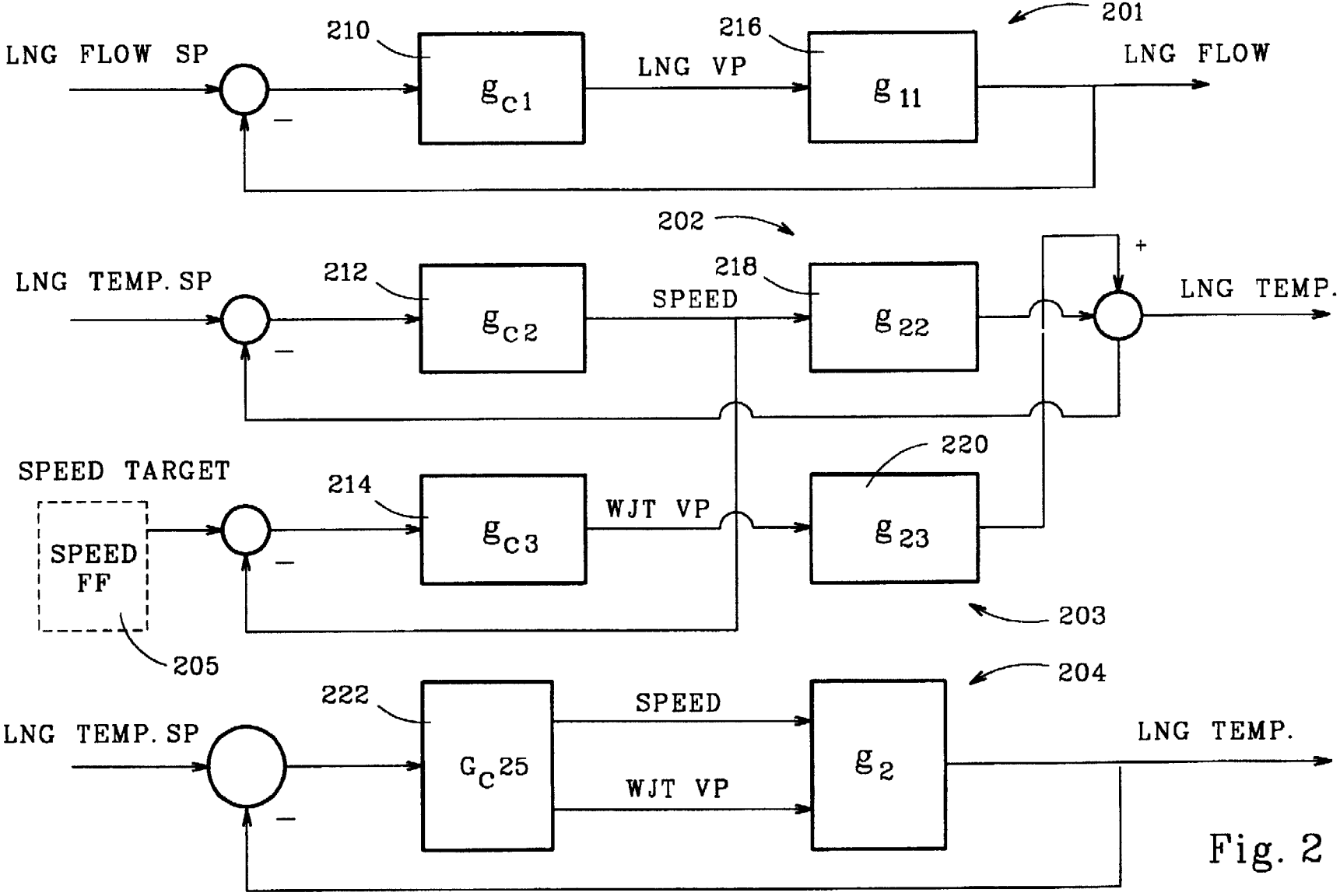
FIG. 2 is a high level block diagram illustrating the basic feedback control for the exemplary speed control-based embodiment of the present invention.

FIG. 2 is a high level block diagram illustrating the basic feedback control scheme for the exemplary speed control-based embodiment of the present invention. As shown in FIG. 2, three feedback loops are provided: a first feedback loop 201 controls the flow rate of LNG through a first manipulated variable (MV), such as LNG offtake valve position; a second feedback loop 202 controls the temperature of the LNG production using a compressor value, such as speed, as a second MV; and a third feedback loop 203 also affects temperature of the LNG by controlling a flow of refrigerant through the system using a third MV such as Warm or Cold JT valve position. Adjustment of this third MV may also be used to maintain the compressor value within a desired operating range by adjusting the refrigeration of the closed loop refrigeration cycle to move LNG temperature in the same direction as that accomplished by compressor value adjustment.

Adjustment of the compressor value has the following effect on the process. By increasing compressor speed, or equivalent compressor value, a decrease in the pressure of the refrigerant at the inlet of the compressor and in line 120 (of FIG. 1) occurs. Consequently, the pressure, and, therefore, the temperature, at the shell side of the heat exchanger decreases, causing an increase in heat transfer, and therefore, in the refrigeration, provided to the natural gas flowing in the heat exchanger 14. A decrease in speed has an opposite effect.

In the control system of the exemplary embodiment of the present invention, there are two control objectives, and, therefore, two key control loops: a first loop controls the LNG flow rate about a setpoint value, and a second loop independently controls the LNG temperature about a setpoint value. The second control loop involves two MVs: a compressor MV, such as speed or equivalent compressor value, with a fast temperature response (which is desirable), but with a relatively weak steady-state gain (not as desirable); and a second MV, such as Warm JT valve position, with a relatively stronger steady-state gain (which is desirable) but with a slower temperature response (not as desirable). The use of two MV for the second control objective improves controllability of the process by using the best features of each MV to compensate for the weaknesses of each MV.

In the first feedback control loop 201, LNG flow is controlled in order to change and maintain the LNG outlet stream (LNG production) to a desired LNG flow rate. This adjustment may be accomplished by, for example, adjusting the position of the LNG offtake valve 30 (FIG. 3). The first feedback loop includes an LNG flow setpoint value which is determined offline or online, and may be determined, for example, from a production schedule for the particular plant.

As is known in the art, the dynamics of any process such as the LNG plant process may be modeled by transfer functions. Plant process 216 models a dynamic response of LNG flow rate to changes in the LNG offtake valve position through process transfer function g11. A flow rate controller 210 adjusts LNG flow rate based upon an error signal indicating a variation of the LNG flow rate with respect to a setpoint value. Flow rate controller 210 offsets these variations in LNG flow rate with respect to the setpoint value by control transfer function $g_{C1}$ derived from the plant process transfer function $g_{11}$.

The error signal is a combination based upon the difference between the actual value of the variable controlled and a setpoint value, which for feedback loop 201 is actual measured LNG flow rate and the desired LNG flow rate setpoint. The error signal may be discrete or continuous, and the form of the error signal is dependent upon the type of controller used. For purposes of the following described embodiments, the adjustment of an MV based upon the error signal corresponding to the variations of the controlled variable about a setpoint is referred to as feedback control.

For example, a simple controller which may be implemented is the Proportional Integral Derivative (PID) controller. For a PID controller, the error signal may be the combination of the difference (e(t)), an integrated difference and a derivative of the difference between the setpoint and measured value. The PID controller output signal $Y_{PID}(t)$ to adjust the MV is given by equation (1), where K is a proportional gain, and F, $1/\tau_i$ and $\tau_d$ are constants:

$$y_{PID}(t) = K\left(Fe(t) + \frac{1}{\tau_i}\int e(t)dt + \tau_d\frac{de(t)}{dt}\right) \quad (1)$$

In another example, the controller may be more complex, such as an internal model controller (IMC). For the IMC, the output signal $Y_{IMC}(t_0)$ to adjust the MV is a more general function of the present and past values of the error signal and is given in general form by equation (2) using discrete sample notation:

$$y_{IMC}(t_0) = f\,be(t-1),\ e(t-2),\ \ldots\ e(t-n)g \quad (2)$$

Techniques to derive the function $g_{C1}$ from the plant transfer function $g_{11}$ are well known in the art. One such technique, commonly known as a model based control method, is described, for example, in chapter 3 and chapter 6 of Robust Process Control, by Manfred Morari and Evanghelos Zafiriou (Prentice Hall, 1989), which is incorporated herein by reference. However, the embodiments of the present invention are not limited to this method and other control theory techniques may be used to determine control transfer functions from the process transfer functions.

As example, the method of determining the system process transfer functions $g_{11}$, $g_{22}$, $g_{23}$, and hence the control transfer functions $g_{C1}$, $g_{C2}$, and $g_{C3}$, is as follows:

First, using a known set of typical initial conditions for all system parameters, subject the open loop system (i.e. the LNG liquefaction process with no control loop) to a step test by applying a step function for the variable under study, letting the system run to a steady-state, and collecting data for all system parameters. In this step, the system may be the plant itself in operation, or a full non-linear dynamic simulation of the plant. For example, if one wishes to find the LNG flow rate transfer function $g_{11}$, the process would be subjected to a step function increase in LNG offtake valve position and resulting LNG flow rate changes recorded.

Second, using a particular system identification software package, collected data from a step test are provided to a system modeling program which creates linear models for the process transfer functions (i.e. $g_{11}$, $g_{22}$, $g_{23}$), which may be in the form of a Laplace Transform for a continuous system or a Z-transform in the discrete domain. Such system identification software package may be, for example, System Identification Toolbox in MATLAB available from the Math Works, Inc. of Natick, Mass.

Next, using the linear models of process transfer functions, find the approximate inverse functions (C1, C2, C3) of each of the system transfer functions (i.e. $g_{11}$, $g_{22}$ and $g_{23}$), and then use model based control methods to derive the controller transfer functions (i.e. $g_{C1}$, $g_{C2}$, and $g_{C3}$).

Finally, tuning constants for the controller model transfer functions may be adjusted based upon dynamic non-linear system simulation. Such simulation subjects the running closed loop control system to a wide variety of operating conditions, while comparing the operation of simulated parameters with known operation of the parameters in the LNG plant.

Returning to FIG. 2, second feedback loop 202 includes an LNG temperature setpoint value which is determined offline, and is a function of process requirements. Consequently, the second feedback loop 202 is used to maintain the LNG outlet stream at or near a desired production temperature value. For this second feedback loop, this may be accomplished by, for example, adjusting compressor speed to control LNG outlet stream temperature. Other compressor values relating to a compressor's capacity, such as guidevane angle of a mixed refrigerant centrifugal compressor or stator blade position of a mixed refrigerant axial compressor, may be used as the MV of the compressor.

As described previously, the dynamics of the LNG plant process may be modeled by a process transfer function, and the plant process 218 models the dynamic process of LNG temperature to changes in refrigeration provided by changes in compressor value through process transfer function $g_{22}$. A Compressor Controller 212 adjusts LNG temperature using feedback control by adjusting a compressor value, such as speed, based upon an error signal derived from the difference between the LNG temperature setpoint and the actual measured LNG outlet stream temperature. The Compressor Controller 212 offsets variations in LNG temperature by control transfer function $g_{C2}$ derived from the process transfer function $g_{22}$.

The third feedback loop 203 of FIG. 2 includes a compressor setpoint value of speed or equivalent value which is determined offline and is related to a value within the desired operating range of the compressor, and may also be determined, for example, from compressor characteristics based on efficiency. In FIG. 2, the third feedback loop is a special form of cascade control known as input resetting, which takes advantage of the availability of an extra MV, such as the position of the Warm JT valve in the exemplary embodiment, to control a single objective, such as the LNG temperature. The techniques of input resetting are known in the art and described, for example, at page 416 in Multivariable Feedback Control, Analysis and Design, by Sigurd Skogestad and Ian Postlethwaithe (J. Wiley and Sons, 1996), which is incorporated herein by reference. For this loop, as shown in FIG. 2, the controller 214 offsets variations in LNG temperature by control transfer function $g_{C3}$ derived from the process transfer function $g_{23}$.

Moving Warm JT valve 18 causes a refrigeration adjustment that has an effect on LNG temperature in the same direction as the compressor speed. This third feedback loop 203 operates in tandem with the second feedback loop 202, and allows the compressor speed to return to its original target value.

In an alternative embodiment of the present invention, a single, multivariable controller may be used to implement feedback control of LNG temperature. Multivariable feedback loop 204 receives an error signal as a combination of the measured LNG temperature and the LNG temperature setpoint value. Plant process transfer function $g_2$ models the response of the LNG temperature to simultaneous changes in compressor speed and Warm JT valve position. Multivariable controller 222 then simultaneously adjusts compressor speed and Warm JT valve position by control transfer function $G_C$25 to move the LNG temperature toward the desired setpoint value.

FIG. 3 is a schematic flow diagram of a typical mixed refrigerant liquefied natural gas plant indicating the placement of sensors and controllers for a speed-based control system implementing the control system as illustrated in FIG. 2. As shown the first feedback loop 201 of FIG. 2 is implemented by the Flow Indicator Controller (FIC) 28, which corresponds to the Flow Rate Controller 210 of FIG. 2, and LNG offtake valve 30. FIC 28 measures the LNG outlet stream flow rate, and receives the LNG flow setpoint SP10. Based on an error signal from a difference of the measured outlet stream flow and setpoint SP10, the position of the LNG offtake valve 30 is opened or closed to maintain the LNG outlet stream at the desired flow rate.

The second feedback loop 202 of FIG. 2 is implemented by the Temperature Indicator Controller (TIC) 26 and compressor speed controllers 36, which together correspond to the Compressor Controller 212 of FIG. 2. TIC 26 measures the actual LNG outlet stream temperature and receives the LNG temperature setpoint SP11. Based on an error signal being a combination of the measured outlet stream temperature and the setpoint SP11, the TIC 26 provides a signal to compressor signal controllers 36 which adjust the compressor speed. As previously indicated, rather than compressor speed, the centrifugal compressor's guidevane angle or axial compressors stator blade position would be changed in other implementations.

The controllers such as the FIC 28 and the TIC 26 are readily available and may be implemented as PID controllers These controllers require the user to provide the controller gains, as well as tuning parameters, as given by equation (1). This information may be determined using model based controller design techniques described previously.

Returning to FIG. 3, the third feedback loop is implemented by the speed indicator controller (SIC) 53, corresponding to the controller 214 of FIG. 2, and Warm JT valve 18.

The SIC 53 adjusts the refrigeration in the following manner for a system using compressor speed as the compressor value. First, the SIC 53 receives the compressor speed signal (which gives the current compressor speed) from the compressor speed controllers 36 and the speed target value (which may be calculated off-line or may be determined from the optimal speed for the current refrigerant mass flow for the closed loop refrigeration cycle), and then SIC 53 calculates a control signal based on an error signal which is a combination of the actual compressor speed and the desired speed target value. Consequently, the SIC 53 adjusts the position of Warm JT valve 18 in response to the control signal to return the compressor speed to the desired speed target value.

The control method as shown in FIG. 2, as described previously, accomplishes two control objectives. The second control objective is implemented as two parts which both control temperature of the LNG outlet stream. The use of two MVs to control LNG temperature helps controllability and in addition allows operation of the LNG control system within constraints imposed by the particular implementation of the LNG plant.

In FIG. 2, one may use only feedback loops 201 and 202 to maintain LNG production while independently maintaining LNG temperature. However, because of the limited range in which the compressor value of the feedback loop 202, such as speed, may be moved, and the low steady-state gain associated with the loop, the extra MV is beneficial. This is to prevent the compressor from being operated at a speed outside of the preferred operating range of the compressor. For example, operating at too a high speed may be very efficient but may damage the compressor components, but operating at too low a speed may cause compressor surge, where mass flows through the compressor reverse. Consequently, one embodiment of the present invention may include the above described third feedback loop, shown as 203 of FIG. 2, to adjust refrigeration provided to the natural gas flowing through the heat exchanger system by adjusting the position of the Warm JT valve 18 to assist the compressor speed in its task. In a situation where the Warm JT valve 18 reaches an upper constraint, for example, further adjustments, including adjustment of LNG flow rate and LNG temperature set points, may be used to return operation of the compressors and position of Warm JT valves 18 to within a desired range.

The setpoint value for the temperature is determined from the desired operating characteristics of the plant. For example, in an LNG plant such as is shown in FIG. 2 employing a flash cycle process, if LNG production reaches a temperature warmer than about −146 degrees centigrade, the LNG production will contain an LNG vapor component which must be flared off by equipment downstream of the heat exchanger, resulting in an unnecessary loss of natural gas. However, if the LNG production reaches a temperature colder than about −151 degrees centigrade, the LNG production will not contain enough vapor component for fueling compressors downstream of the heat exchanger. Such downstream compressors use the natural gas of vapor component as a fuel source to power the compressors, and the operating characteristics of the downstream compressors will determine the low end operating temperature. Therefore, desired operating temperature setpoint of LNG production may be selected within this temperature range.

For a sub-cooled process, no vapor is required in the LNG outlet stream, and the desired temperature setpoint is determined by the characteristics of the downstream storage tank (if temperature is too warm, LNG vapor flashing occurs, but if the temperature is too cold, the liquefaction process is inefficient).

In the present embodiment, once the Warm JT valve 18 is adjusted, a further control loop can be used to adjust a position of the Cold JT valve 16 to control MRV flow and a MRV flow setpoint may be adjusted to control MRL/MRV flow ratio. As shown in FIG. 3, a Flow Ratio Controller (FRC) 51 receives a MRL/MRV flow ratio from flow ratio detector (FR) 52 and compares the MRL/MRV flow ratio to a predetermined setpoint value. Based on an error signal formed as a combination of actual and desired MRL/MRV flow ratio, a control signal is provided to the Cold JT valve 16 to adjust the valve position. This additional feedback loop is needed to maintain a proper balance of flows within the heat exchanger to prevent, for example, the return temperature of line 120 from getting too cold, which may damage equipment.

Several available variables may be adjusted as additional MVs to maintain operation of various elements of the closed loop refrigeration cycle within operating constraints of the system. For example, returning to FIG. 3, the Warm JT valve 18 and Cold JT valve 16 may each reach the fully open or fully closed positions, the mixed refrigerant ratio may be outside of a target value, or the mixed refrigerant (MRV or MRL) temperatures outside of acceptable ranges. If these MVs reach the constraints, the system may require: the compressor speed target be increased or decreased if the Warm JT valve 18 or the Cold JT valve 16 reach an upper or lower constraint, the MRL/MRV flow ratio be decreased if the temperature of MR exiting the heat exchanger at the warm bundle 110 (suction to first compressor) is too cold, and compressor antisurge control be achieved by opening the compressor recycle valve(s) when a predetermined distance to surge is reached. Further constraints may be based on mixed refrigerant compressor discharge pressure or mixed refrigerant compressor power. Satisfying these constraints may be accomplished by either operator intervention or by a computer monitoring and control system separate from the described exemplary embodiment.

Finally, certain actions can be added to improve process efficiency. For such an exemplary system, feedforward calculations using measured values of the current MR may be used to determine a new compressor speed target value based upon the mass of refrigerant flowing through the system. FIG. 2 shows this additional Speed Feedforward block 205 providing the speed target setpoint value, and the calculations are described in more detail below with reference to the refrigerant recirculation-based control method. In such a case, for example, values of a table or graph showing optimal compressor speed for a given mixed refrigerant mass flow rate may be used to adjust compressor speed target value. Optimal compressor values for these purposes may be based on an independent variable, for example, compressor efficiency.

Target values for the MR compressor speed, or mixed refrigerant centrifugal compressor guidevane angle or mixed refrigerant axial compressor stator blade angle, may be determined using an off-line or on-line steady-state optimization computer program or calculation receiving a number of variables or factors including, but not limited to: (a) LNG production target; (b) natural gas feed conditions; (c) mixed refrigerant inventory; (d) mixed refrigerant composition; (e) operating pressures; (f) available power; (g) equipment design; (h) compressor characteristics; and/or (i) external conditions.

Target values for the MRL/MRV flow ratio may be determined by using an off-line or on-line steady-state optimization computer program or calculation receiving a number of variables or factors including and not limited to: (a) LNG production target; (b) natural gas feed conditions; (c) mixed refrigerant inventory; (d) mixed refrigerant composition; (e) operating pressures; (f) available power; (g) equipment design; (h) compressor characteristics; and/or (i) external conditions.

Refrigerant Recirculation-Based Control System

The second exemplary embodiment of the present invention employs a refrigerant recirculation based control system employing feedforward and feedback control to adjust the temperature of the LNG production by changing MRL and MRV flow rates (to change Total MR flow), MRL/MRV flow ratio and then Total MR flow/LNG flow ratio, and then adjusting a compressor MV such as speed to a value within an optimal operating range of the compressor for the current MR mass flow.

Figure 4:
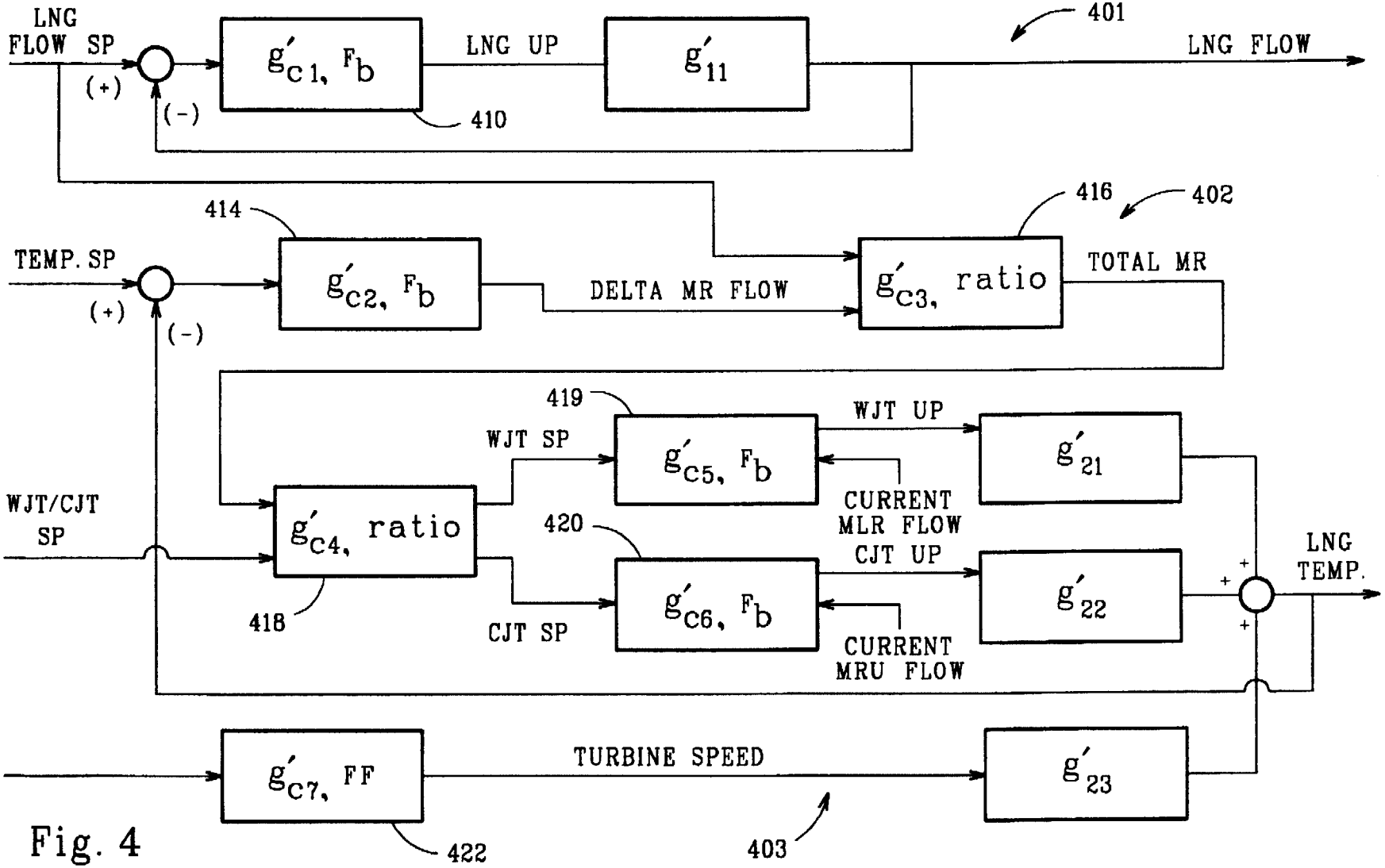
FIG. 4 is a high level block diagram illustrating the basic feedback control for the exemplary recirculation-based embodiment of the present invention.

FIG. 4 is a high level block diagram illustrating the basic control feedback and feedforward loops for the exemplary recirculation-based embodiment of the present invention. The exemplary embodiment includes three main control sections: a first feedback loop 401 controls the flow rate of LNG production; a second feedback and feedforward section 402 controls the temperature of the LNG production; and a third feedforward section 403 adjusts compressor speed to maintain the compressor speed within an optimal range based upon the mass of refrigerant (the total MR) flowing through the closed loop refrigeration cycle.

Figure 5:
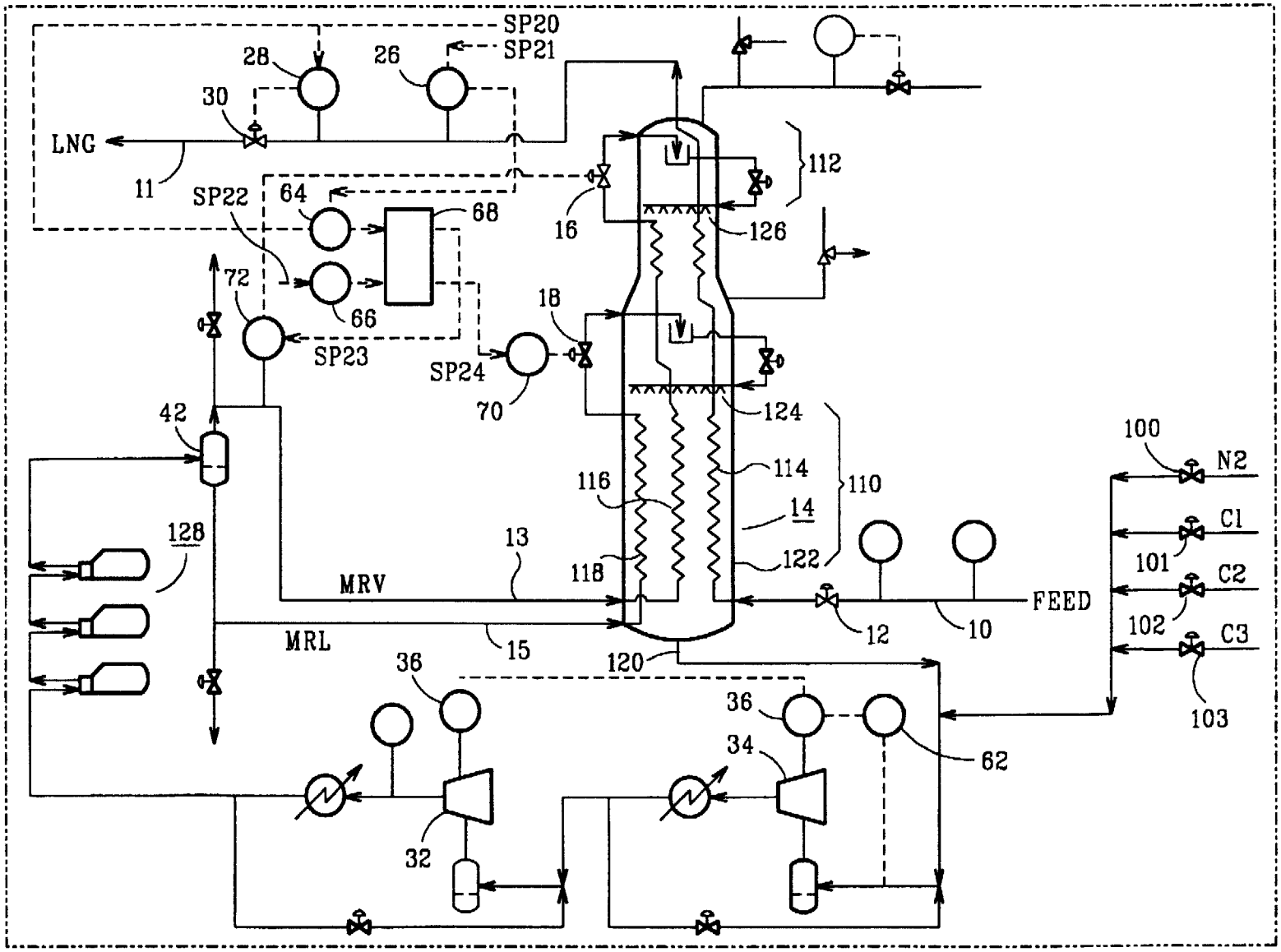
FIG. 5 is a schematic flow diagram of a typical mixed refrigerant liquefied natural gas plant indicating the placement of sensors for a recirculation-based control system as illustrated in FIG. 4.

In the first feedback control loop 401, LNG flow is controlled in order to change and maintain the LNG outlet stream (LNG production) to a desired production LNG flow rate, and may be accomplished by, for example, adjusting the position of the LNG offtake valve 30 (FIG. 5). The first feedback loop includes an LNG flow setpoint value which is determined offline, and may be determined, for example, by production requirements.

The dynamics of the LNG plant process may be modeled by transfer functions and the techniques described with reference to the compressor speed based control method may be used. Plant process of 401 models dynamic process of LNG flow rate to changes in LNG offtake valve position through transfer function $g_{11}'$. A flow rate controller 410 adjusts LNG flow rate, based upon an error signal formed from a combination of the LNG flow rate setpoint and the actual measured LNG flow rate. The flow rate controller 410 offsets variations in LNG flow rate by control transfer function $g_{C1}'$ which may be derived from the process transfer function $g_{11}'$.

The LNG flow setpoint value, process transfer function $g_{11}'$ and control transfer function $g_{C1}'$ may be the same as the LNG flow rate setpoint, process transfer function $g_{11}$ and control transfer function $g_{C1}$ for the compressor speed-based control method shown in 201 of FIG. 2.

The second section 402 is an LNG temperature feedback/feedforward control system which maintains the LNG temperature about a setpoint value using an LNG Temperature setpoint value and a ratio of Warm JT valve and Cold JT valve setpoints. Control of the LNG temperature is done by adjustment of the desired target value of the ratio of total MR flow rate to LNG flow rate. First, a current measured LNG outlet stream temperature is compared to an LNG Temperature setpoint value to provide an error signal to MR Change Controller 414 which determines by control transfer function $g_{C2}'$ an incremental change in mixed refrigerant flow rate, defined as a Delta MR flow rate value, to offset the difference in LNG outlet temperature. Using the Delta MR flow rate value and the LNG flow setpoint value, a Total MR Controller 416 determines by control transfer function $g_{C3}'$ the Total MR Flow Rate necessary from the following equation (3):

$$\text{Total MR Flow Rate}=\text{Delta MR flow rate}+(\text{LNG Flow Setpoint Value} * \text{Total MR to LNG Flow ratio}) \quad (3)$$

Second, the Total MR flow rate and a MRL/MRV ratio setpoint are used to adjust the MRL flow rate and MRV flow rate of the MR recirculating through the process. The total MR flow rate and a MRL/MRV ratio setpoint are provided to MRL/MRV Ratio Controller 418 which determines by control transfer function $g_{C4}'$ a new MRL flow rate setpoint and a new MRV flow rate setpoint, which are given by the following equations (4) and (5):

$$\text{new MRV flow rate setpoint}=\text{Total MR Flow Rate} * 1/(\text{MRL/MRV ratio setpoint}+1) \quad (4)$$

$$\text{new MRL flow rate setpoint}=\text{Total MR flow rate}-\text{MRV flow rate setpoint.} \quad (5)$$

Once the new MRV and MRL flow rate setpoint values are determined, two feedback control loops control the individual MRL and MRV flow rates. The first of these employs MRL flow controller 419 which receives the MRL flow rate setpoint value and the current measured MRL flow rate and forms an error signal as a combination of these MRL flow rate values, and through control transfer function $g_{C5}'$ adjusts the MRL flow rate, for example, by adjusting the position of Warm JT valve 18. Similarly, the second control loop employs MRV flow controller 420 which receives the MRV flow rate setpoint value and the current measured MRV flow rate and forms an error signal as combination of these MRV flow rate values, and through control transfer function $g_{C6}'$ adjusts the MRV flow rate, for example, by adjusting the position of Cold JT valve 16. In the manner as described previously, the control transfer functions $g_{C5}'$ and $g_{C6}'$ may be determined from the open loop modeled LNG plant process transfer functions $g_{21}'$ and $g_{22}'$ which relate the LNG plant process to the MRL and MRV flow rate effect on the LNG outlet stream temperature.

FIG. 5 is a schematic flow diagram of a typical MR LNG plant 40B indicating the placement of sensors and controllers for a recirculation-based control system implementing the control system as illustrated in FIG. 4.

Referring to FIG. 5, the first control loop 401 of the recirculation based control system of FIG. 4 maintains the LNG outlet stream at a predetermined flow rate given by setpoint SP20, and the first control loop includes Flow Indicator Controller 28, and LNG offtake valve 30, and operates in a manner similar to the first control loop of the compressor speed-based system. FIC 28 measures the LNG outlet stream flow rate, and receives the LNG flow setpoint SP20. Based on an error signal formed as a combination of the measured outlet stream flow and setpoint SP20, the position of the LNG offtake valve 30 is opened or closed to maintain the LNG outlet stream at the desired flow rate.

The second feedforward/feedback control loop 402 of FIG. 4 of the recirculation based control system is shown in FIG. 5 and includes Temperature Indicator Controller (TIC) 26, Total MR Flow Rate Controller TMR FRC 64, MRL and MRV Flow Rate Controller (MR L/V FRC) 66, Feed Forward Logic (FFL) 68, MRV Flow Indicator Controller (MRV FIC) 72 for adjusting MRV flow by adjustment of Cold JT Valve 16, and MRL Flow Indicator Controller (MRL FIC) 70 for adjusting MRL flow by adjustment of Warm JT Valve 18.

TIC 26 receives an LNG outlet stream setpoint value SP21 corresponding to the desired outlet stream temperature of the LNG, and also measures the current temperature of the LNG outlet stream. Based on an error signal, which is related to the difference between the current temperature and the setpoint value SP21, a TIC 26 provides a temperature adjustment control signal which indicates the Delta MR flow necessary to adjust LNG temperature, and this control signal is provided to the TMR FRC 64, which corresponds to the Total MR Controller 416 of FIG. 4. TMR FRC 64 also receives the setpoint value SP20 corresponding to the desired LNG outlet stream flow rate. Using equation (1), TMR FRC 64 provides the FFL 68 a desired total MR flow rate.

In addition, MRL and MRV Flow Ratio Controller (MR L/V FRC) 66, which corresponds to the MRL/MRV Ratio Controller 418 of FIG. 4, receives a MRL/MRV flow rate ratio setpoint value SP22 and the current MR flow rate from TMR FRC 64, and provides new MRL and MRV flow rate setpoints, which are received and converted into setpoint values SP23 and SP24 respectively by FFL 68 using the equations (2) and (3).

Finally, the MRL controller 419 and MRV Controller 420 are implemented by the MRV Flow Indicator Controller (MRV FIC) 72 for adjusting MRV flow based upon new setpoint value SP23 by adjustment of Cold JT Valve 16, and MRL Flow Indicator Controller (MRL FIC) 70 for adjusting MRL flow based upon new setpoint value SP24 by adjustment of Warm JT Valve 18.

Consequently, the control of the MRL flow rate to a desired setpoint value is provided by feedback loop adjusting the position of Warm JT Valve 18, and control of the MRV flowrate to a desired setpoint value is done by feedback via adjustment of the Cold JT valve 16. The desired target setpoint value SP22 for the ratio of mixed refrigerant liquid flow to mixed refrigerant vapor (MRL/MRV) flow rate is maintained by adjusting the setpoint value SP24 of the MRL flowrate. Finally, the ratio of total MR flow rate to LNG flow rate is attained by adjusting the setpoint value SP23 of the MRV flowrate. In this manner, the LNG outlet temperature is maintained near the setpoint value SP21 and the LNG outlet stream flow rate is maintained near the setpoint value SP20.

Returning to FIG. 4, Feedback loop 401 and LNG temperature feedback/feedforward section 402 maintain LNG production while independently maintaining LNG temperature. Maintaining temperature by fast response by changing the MRL, MRV, and total MR flow/LNG flow may result in the compressor being operated at a speed outside of the preferred operating range of the compressor for a given mass of refrigerant flowing through the compressor. Consequently, an embodiment of the present invention may include a third feedforward section 403 having control process 422 with control transfer function $g_{C7}'$, as shown FIG. 4, which adjusts the compressor speed based on the mass of total refrigerant flowing through the compressor system. The output compressor speed provided through gain $g_{C7}'$ affects LNG outlet temperature through process transfer function $g_{23}'$.

As shown in FIG. 5, the feedforward section 403 of FIG. 4 may be implemented by Feedforward controllers (FF) 62 and Speed Controller pair 36 and 38 for each respective compressor stage (i.e. low pressure compressor 34 and high pressure compressor 32). Although the present embodiment is described for compressor speed, equivalent compressor values may be used such as, but not limited to, stator blade position or guidevane angle. FF 62 measures the received MR mass flow. The FF 62 then provides a compressor value to the speed controller 36 and 38 to adjust operation of the compressor, the respective low pressure compressor 34 or high pressure compressor 32, based on available information of compressor efficiency. Such adjustment may further be based on performance curves derived from compressor performance as a function of mass flow rate of MR.

In a third control loop, speeds of the mixed refrigerant low pressure and high pressure compressors 34 and 32 are additionally and separately adjusted by FF 62. Each FF 62 measures the current mixed refrigerant flow rate for the respective compressor and sends speed control signal to the respective compressor speed controller 36 or 38 based upon a desired mass flow rate for low pressure compressor 34 or high pressure compressor 32 to ensure maximum compressor efficiency. Compressor speed controller 36 or 38 then sets the respective compressor speed accordingly. In plants where speed is fixed or cannot be changed for adequate control, moving an equivalent variable is possible. For example, guidevane angles of one or more mixed refrigerant centrifugal compressors may be adjusted as a function of the current mass flow rate for each compressor to ensure maximum compressor efficiency. Also, stator blade angles of one or more mixed refrigerant axial compressors may be adjusted as a function of the current mass flow rate for each compressor to ensure maximum compressor efficiency.

Compressor antisurge control is achieved by opening the compressor recycle valve(s) when a predetermined compressor surge level is reached. This may be accomplished by, for example, operator intervention or a dedicated anti-surge controller.

Constraint control of the temperature of the recirculating refrigerant at the warm bundle 110 of the main cryogenic heat exchanger may be accomplished by determining an appropriate low temperature constraint value for temperature at the warm bundle 110 through, for example, operational requirements of the system; and then measuring the warm end temperature and comparing the measured warm end temperature to the constraint value. If the temperature is less than the constraint value, the desired target value of the MRL/V flow ratio is reduced.

Target values for the mixed refrigerant compressor speed, or mixed refrigerant centrifugal compressor guidevane angle or mixed refrigerant axial compressor stator blade angle, are determined using an off-line or on-line steady-state optimization computer program or calculation receiving a number of variables or factors including, but not limited to: (a) mixed refrigerant composition; (b) operating pressures; (c) available power; (d) equipment design; (e) compressor characteristics; and/or (f) external conditions.

Target values for the MRL to MRV flow ratio are determined by using an off-line or on-line steady-state optimization computer program or calculation receiving a number of variables or factors including and not limited to: (a) LNG production target; (b) natural gas feed conditions; (c) mixed refrigerant inventory; (d) mixed refrigerant composition; (e) operating pressures; (f) available power; (g) equipment design; (h) compressor characteristics; and/or (i) external conditions.

Modeling the Exemplary Embodiments of the Present Invention

Results of a dynamic simulation of an LNG plant employing the control systems and rigorous non-linear models of the LNG process may be analyzed in order to compare performance of the LNG plant control methods as shown in FIG. 3 and FIG. 5. The designed control system transfer functions and the linear models used to define the process transfer functions may be determined as described previously. The performance of the speed-based control method and the recirculation-based control method are demonstrated using a rigorous, non-linear model of a typical two-bundle baseload LNG plant. The results are from closed-loop dynamic simulations of the MCHE/MCR loop section. Table 1 lists system parameters, including key process variables and the corresponding initial steady-state values, for the non-linear model used in the exemplary dynamic simulation. The values of Table 1 represent a "snap-shot" in time of the LNG plant being modeled.

TABLE 1

| MODEL VARIABLES FOR LNG PLANT MODEL | TAG | | PLANT | SIMULATION | % ERROR |
|---|---|---|---|---|---|
| VALUE POSITION | | | | | |
| LNG offtake | E5TIC01A | MV | 76 % | 90.62 % | 16.18 |
| Cold JT | E5PRIC15 | MV | 82 % | 90.075 % | 9.85 |
| Warm JT | E5FIC002 | MV | 83 % | 97.461 % | 17.42 |
| COMPRESSOR SPEED | | | | | |
| 4K-2 | E4SI023A | set | 4556 rpm | 4556 rpm | 0.00 |
| 4K-3 | E4SI028A | set | 4499 rpm | 4499 rpm | 0.00 |
| FLOWS | | | | | |
| LNG product after flash tank | E5FI006A | | 715 m3/h | m3/h | |
| LNG offtake from MHE | calc. | | 18687 kmol/h | 18110.27 kmol/h | −3.09 |

TABLE 1-continued

| MODEL VARIABLES FOR LNG PLANT MODEL | TAG | | PLANT | SIMULATION | % ERROR |
|---|---|---|---|---|---|
| MRV | E5FI001A | | 173200 Nm3/h | 183666 Nm3/h | 6.04 |
| MRV | calc. | | 7732 kmol/h | 8196.58 kmol/h | 6.01 |
| MRL | E5FIC002 A | | 870 m3/h | m3/h | |
| MRL | calc. | | 17352 kmol/h | 19683.98 kmol/h | 13.44 |
| 4K-2 Discharge | E4FI010B | | 608897 Nm3/h | 624738.8 Nm3/h | 2.60 |
| 4K-3 Discharge | E4FI011B | ? | 578101 Nm3/h | 624738.8 Nm3/h | 8.07 |
| PRESSURES | | | | | |
| Shell, cold end | E5PIC002 | | 3.663 kg/cm2a | 3.746 kg/cm2a | 2.27 |
| Shell, warm end | E5PI009 | | 3.203 kg/cm2a | 3.16 kg/cm2a | −1.34 |
| LNG offtake | E5PI010 | | 21.903 kg/cm2a | 23.161 kg/cm2a | 5.74 |
| Feed | E5PI012 | | 38.523 kg/cm2a | 38.573 kg/cm2a | 0.13 |
| MRV, cold end | E5PI008 | | 29.843 kg/cm2a | 29.763 kg/cm2a | −0.27 |
| MRV, warm end | E5PI001 | | 46.333 kg/cm2a | 47.172 kg/cm2a | 1.81 |
| MRL, midpoint | E5PI007 | | 36.993 kg/cm2a | 40.0998 kg/cm2a | 8.40 |
| MRL, warm end | E5PI001 | | 46.333 kg/cm2a | 47.258 kg/cm2a | 2.00 |
| 4K-2 Suction | E5PI0036 | | 3.2 kg/cm2a | 3.129 kg/cm2a | −2.22 |
| 4K-2 Discharge | E5PI015A | | 13.85 kg/cm2a | 13.503 kg/cm2a | −2.51 |
| 4K-3 Suction | E5PI0041 | | 13.543 kg/cm2a | 13.07 kg/cm2a | −3.49 |
| 4K-3 Discharge | E5PI017B | | 49.85 kg/cm2a | 49.119 kg/cm2a | −1.47 |
| HPSEP | E5PI001 | | 46.333 kg/cm2a | 47.1722 kg/cm2a | 1.81 |
| TEMPERATURES | | | | | |
| Shell, cold end | E5TI024 | ? | −144.02 C. | −156.38 C. | −9.57 |
| Shell, midpoint | E5TI025 | | −117.7 C. | −120.16 C. | −1.58 |
| Shell, warm end | E5TI008 | | −35.7 C. | −35.857 C. | −0.07 |
| LNG offtake | E5TIC01A | | −147 C. | −146.087 C. | 0.72 |
| LNG, midpoint | E5TI26/27 | avg | −117.7 C. | −113 C. | 3.02 |
| Feed | E5TI023 | | −33.3 C. | −33.248 C. | 0.02 |
| MRV, cold end | E5TI030 | | −144 C. | −147.447 C. | −2.67 |
| MRV, midpoint | E5TI021 | | −117.1 C. | −109.82 C. | 4.67 |
| MRV, warm end | E5TI047 | | −32.8 C. | −33.1 C. | −0.12 |
| MRL, midpoint | E5TI031 | | −116.6 C. | −108.332 C. | 5.28 |
| MRL, warm end | E5TI047 | | −32.8 C. | −33.096 C. | −0.12 |
| 4K-2 Suction | E4TI004B | | −38.7 C. | −36.0657 C. | 1.12 |
| 4K-2 Discharge | E4TI007B | | 59.7 C. | 57.08 C. | −0.79 |
| 4K-3 Suction | E4TI006B | | 30.5 C. | 30.2046 C. | −0.10 |
| 4K-3 Discharge | E4TI008B | | 129.3 C. | 127.777 C. | −0.38 |
| HPSEP | E4TI047 | | −32.8 C. | −33.1 C. | −0.12 |
| COMPOSITIONS | | | | | |
| Feed, N2 | | | 9.52E-03 | 9.30E-03 | −2.31 |
| Feed, C1 | | | 0.9188 | 0.8976 | −2.31 |
| Feed, C2 | | | 0.0517 | 0.0505 | −2.32 |
| Feed, C3 | | | 0.021 | 0.050969 | 78.66 |
| Feed, C4 | | | 4.02E-02 | 0 | x |
| Feed, I4 | | | 3.49E-02 | 0 | x |
| Feed, I5 | | | 1.75E-04 | 0 | x |
| MCR, N2 | | | 0.0564 | 0.05648 | 0.14 |
| MCR, C1 | | | 0.4094 | 0.4044579 | −1.21 |
| MCR, C2 | | | 0.4617 | 0.4556615 | −1.31 |
| MCR, C3 | | | 0.0725 | 0.0833973 | 15.03 |
| VARIOUS | | | | | |
| MR Flow ratio | | calc | 2.2441 | 2.4014 | 7.01 |
| MR/LNG Flow Ratio | | calc | 1.3423 | 1.5394 | 14.69 |
| Compression Ratio | | | 15.12 | 15.6979 | 3.82 |
| HPSEP Level | | | 63 % | 59 % | 6.349 |

These values of Table 1 are steady-state values at a particular instant of time. As known in the art, each particular LNG plant has different operating characteristics, and a dynamic simulation of an LNG plant using a non-linear model would be customized for the particular LNG plant. Consequently, the comparison, control objectives and corresponding steady-state operating values of Table 1 are exemplary.

TABLE 2

| Control Objectives | | |
|---|---|---|
| Control Variable | Setpoint | Allowed range |
| LNG flow | 18110 kmol/h | +/−2% |
| LNG temperature | −146 C. | +/−2.5 C. |

TABLE 2-continued

| MV Constraints | | | |
|---|---|---|---|
| MV | Max | Min | Rate of Change |
| LNG, CJT, WJT | 1.16 | 0 | |
| 4K-2 Speed | 4900 rpm | 3500 rpm | <5 rpm/sec |
| 4K-3 Speed | 4900 rpm | 3500 rpm | <5 rpm/sec |
| **Output constraints** | | | |
| Variable | Max constraint | Min constraint | |
| Discharge pressure | 51 kg/cm2a | | |
| Shell temp, warm end | | −38 C. | |
| Distance to surge | | 8% away from surge | |

Table 2 gives exemplary maxima, minima and range s for control objectives, and also MV and output constraints. In order to relate these objectives to other systems, a brief description follows of how these objectives are determined. For LNG flow rate, the maximum value of LNG plant production is determined by the particular plant and natural gas supply, and the minimum value is zero, corresponding to a shut down of the plant. Consequently, for LNG flow rate, the desired flow rate is determined by LNG plant operators and plant production schedule. Once the desired flow rate is determined, the exemplary control objective of +/−2% change relates to typical values currently used for flow control in LNG plants. Larger values for a range of LNG flow rate change may be used up to the maximum and minimum values, but the efficiency of the LNG plant may be affected. Smaller values for a range of LNG flow rate change may also be used, but the minimum range will be determined by the accuracy of the measurement devices, the accuracy of the control element, and the characteristics of the transient response of the LNG plant process. Consequently, the minimum range may be found from a study of the LNG plant or by simulation.

Determination of maximum and minimum operating ranges for the temperature of the LNG outlet stream was described previously, and is dependent upon the downstream processes such as, but not limited to, flash cycle, sub-cooled process or other transport or storage considerations. The exemplary range of LNG temperature variation of +/−2.5 degrees centigrade is determined from typical plant operation, but smaller ranges may be used. The minimum range will be determined by the accuracy of the measurement devices, the accuracy of the control element, and the characteristics of the transient response of the LNG plant process.

Determination of maximum and minimum operating ranges for the low pressure and high pressure compressors is dependent upon the manufacturers specifications for the particular compressors used. The exemplary range of compressor speed variation of less than 5 rpm/sec is determined from typical plant compressors. The maximum rate of change will be determined by the machinery operational considerations.

Also as described previously, the operating range of the Warm JT, Cold JT and LNG offtake valves is between fully open and fully closed, and these are allowed to move freely within this range.

Finally, the output constraints are also determined by the particular LNG plant design. The discharge pressure is determined by the design pressure of the heat exchange circuit, the shell temperature at the warm end is determined by the minimum temperature before damaging downstream equipment, which may be approximately −50 degrees centigrade, with −38 degrees centigrade typically used in LNG plant operation. The distance to surge is set at a reasonable value to prevent damage to the compressors.

For the given example using the compressor speed-based control method as illustrated by FIG. 2 and PID controllers implementing the control functions, the control transfer functions have the following tuning parameters: for $g_{C1}$ (Control of LNG flow rate), the proportional gain is $10^{-5}$ 1/(kgmoles/hr), and integral time $\tau_I$ is 2 sec.; and for $g_{C2}$ (Control of LNG Temperature), the proportional gain is −500 rpm/C, and the integral time $\tau_I$ is 295 sec. For the third feedback loop, a model-based control algorithm is used, as described previously. This includes a first order filter, and the filter time constant is used as the adjustable tuning parameter. The time constant is related to the desired speed of the response of the closed-loop system, and may be limited by stability considerations.

For the given example using the refrigerant recirculation-based control method as illustrated by FIG. 4, the proportional gain constants have the following tuning parameters: for $g_{C1}'$ (Control of LNG flow rate), the proportional gain is $10^{-5}$ 1/(kg-moles/hr), and the integral time $\tau_I$ is 2 sec.; for $g_{C2}'$ (Control of LNG Temperature), the proportional gain is 600, and the integral time $\tau_I$ is 2500 sec.; for $g_{C3}'$, the gain is determined from the model of the process derived from the open loop response; for $g_{C4}'$, the gain is determined from the model of the process derived from the open loop response; for $g_{C5}'$ (Control of Warm JT valve flow rate), the proportional gain is $10^{-5}$ 1(kg-moles/hr), and the integral time $\tau_I$ is 1 sec.; for $g_{C6}'$ (Control of Cold JT valve flow rate) the proportional gain is $3.528\times10^{-6}$ 1/(kg-moles/hr), and the integral time $\tau_I$ is 1 sec.; and for $g_{C7}'$, the gain is determined from the model of the process derived from the open loop response.

Four different simulation scenarios are illustrated. Results are presented for both the speed-based control method and the recirculation-based control method, and compared when appropriate, to the desired setpoint values. The results of the simulation scenarios are illustrated in FIGS. 6 through 9, which are given as the behavior of various variables under study as a function of time. The time scale used in FIGS. 6 through 9 is given in seconds (28800 seconds=8 hours.) The illustrated simulations of FIGS. 6 through 9 show that both the compressor speed-based method (marked (a)) and the recirculation-based method (marked (b)) adequately satisfy the control objectives of the various scenarios.

Figure 6A:
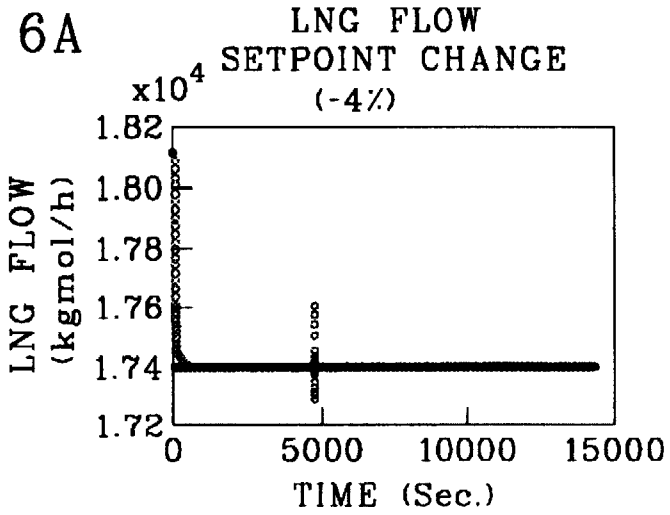
FIG. 6A is a graph illustrating control of LNG flow rate versus time for a 4% step reduction in LNG flow setpoint scenario.
Figure 6B:
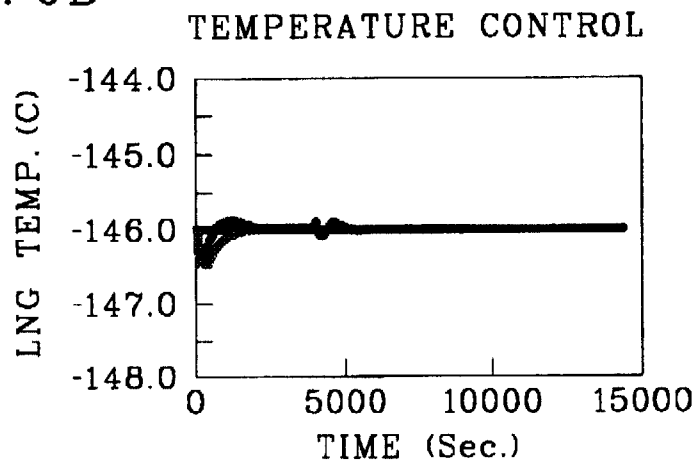
FIG. 6B is a graph illustrating control of LNG temperature versus time for a 4% step reduction in LNG flow setpoint scenario.
Figure 6C:
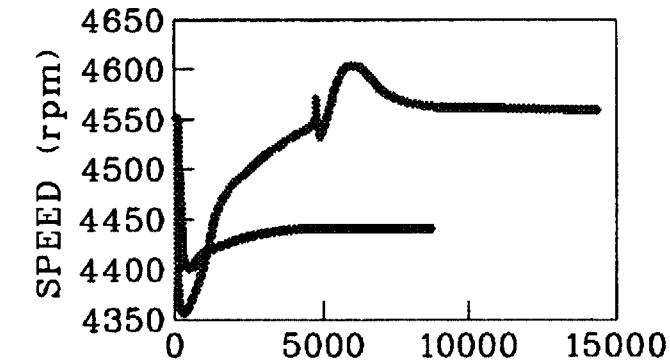
FIG. 6C is a graph illustrating control of compressor speed versus time for a 4% step reduction in LNG flow setpoint scenario.
Figure 6D:
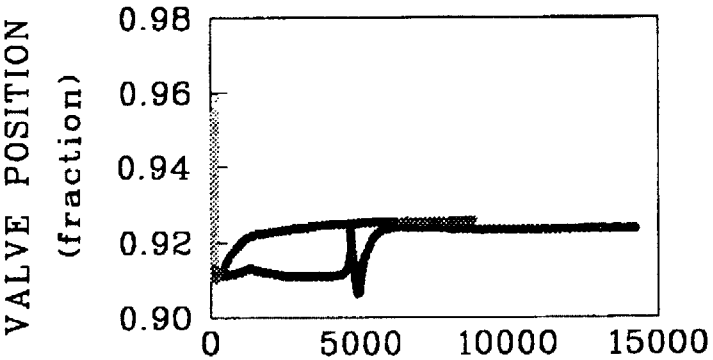
FIG. 6D is a graph illustrating control action by warm JT valve position versus time for a 4% step reduction in LNG flow setpoint scenario.

FIGS. 6A through 6B illustrate the performance of the compressor speed based and recirculation based control methods using a 4% step reduction in LNG flow setpoint scenario. FIG. 6A is a graph illustrating control of LNG flow rate versus time, FIG. 6B is a graph illustrating control of LNG temperature versus time, FIG. 6C is a graph illustrating control of compressor speed versus time, and FIG. 6D is a graph illustrating movement of warm JT valve position versus time for the 4% step reduction in LNG flow setpoint scenario.

FIG. 6A and FIG. 6B illustrate that tight control of flow and temperature respectively is achieved with both the compressor-speed based control method and the recirculation based control method. FIG. 6C shows the compressor speed as a function of time. Both control methods show a fast initial reduction in the speed to correct for the initial temperature reduction due to lower heat load. As indicated earlier, the speed-based strategy is designed to reset the speed back to its original target value (4550 rpm for this example), and does so by employing the Warm JT valve position as an additional MV. Reducing the opening of the Warm JT valve has an effect on the LNG temperature that is in the same direction, although slower than, that of the compressor speed. The combined effect of both MVs, when arranged according to the scheme shown in FIG. 3, drives the compressor speed back to its original value soon after the initial move. For this example, at the new steady-state the speed has been reset to its original target value and the warm JT has closed by about 5%.

Figure 7B:
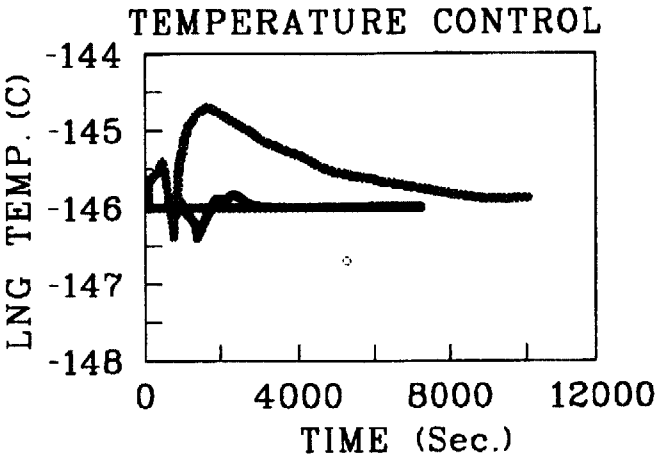
FIG. 7B is a graph illustrating control of LNG temperature versus time for a 4% step increase in LNG flow setpoint scenario.
Figure 7D:
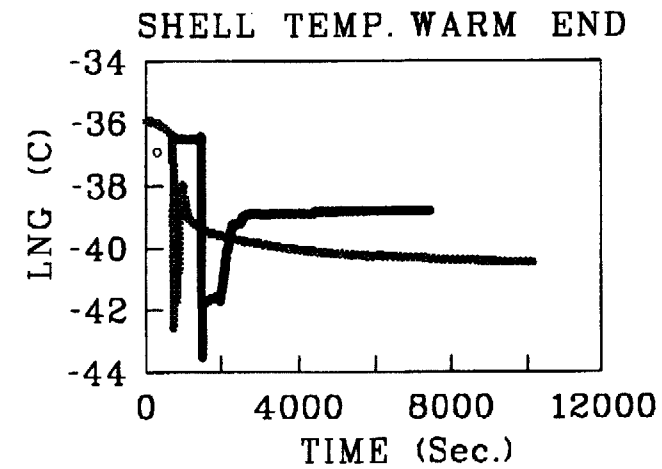
FIG. 7D is a graph illustrating shell temperature of a heat exchanger versus time for a 4% step increase in LNG flow setpoint scenario.
Figure 7A:
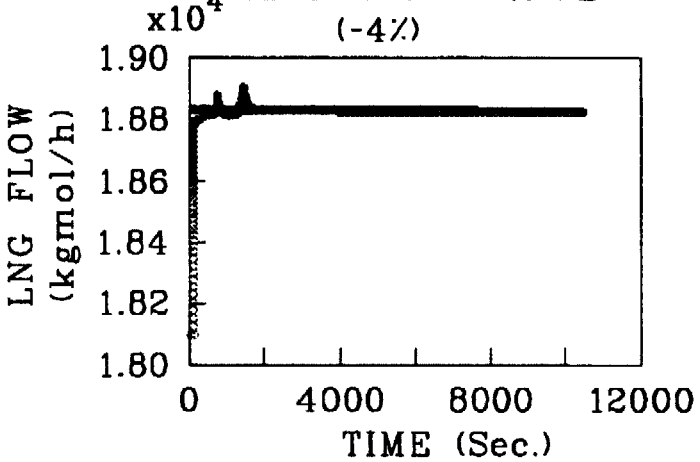
FIG. 7A is a graph illustrating control of LNG flow rate versus time for a 4% step increase in LNG flow setpoint scenario.
Figure 7C:
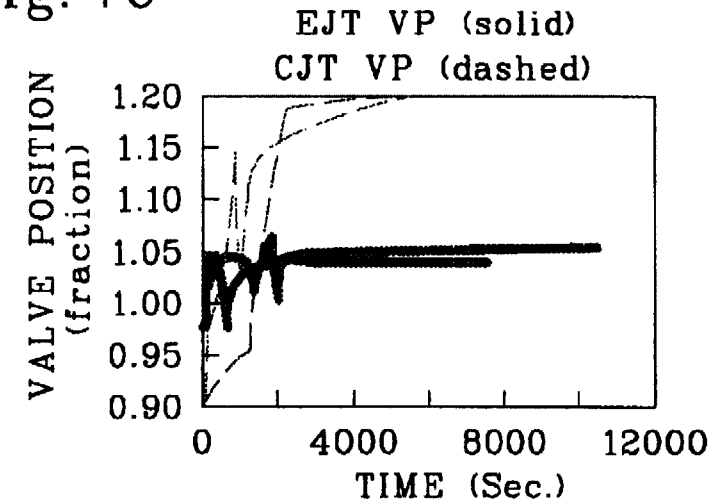
FIG. 7C is a graph illustrating control action by warm JT valve position and cold JT position versus time for a 4% step increase in LNG flow setpoint scenario.
Figure 7E:
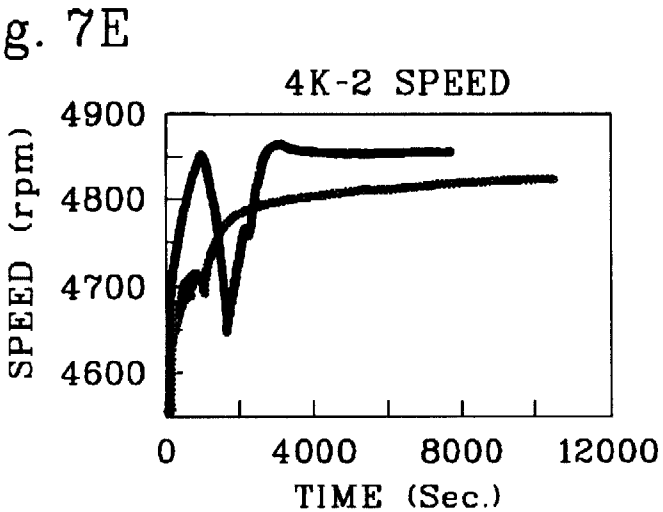
FIG. 7E is a graph illustrating control of compressor speed versus time for a 4% step increase in LNG flow setpoint scenario.

FIGS. 7A through 7E illustrate the performance of the compressor speed based and recirculation based control methods using a 4% step increase in LNG flow setpoint scenario. FIG. 7A is a graph illustrating control of LNG flow rate versus time, FIG. 7B is a graph illustrating control of LNG temperature versus time, FIG. 7C is a graph illustrating warm JT valve position and cold JT position versus time, FIG. 7D is a graph illustrating shell temperature of a heat exchanger versus time, and FIG. 7E is a graph illustrating control of compressor speed versus time for a 4% step increase in LNG flow setpoint scenario.

The performance as illustrated in FIGS. 7A through 7E shows that both LNG flow and temperature are also controlled in this scenario well within the required range of Table 2, although the temperature response is slower for the recirculation-based method. The FIGS. 7A through 7E illustrate some of the constraint control actions for this scenario. The initial steady-state LNG outlet stream is already a high production value, and the LNG flow rate setpoint is further increased by 4%. The Warm JT valve position does not hit its constraint (defined at 1.16 in Table 2), but the Cold JT valve does reach a constraint. In the case of the speed-based method, the Cold JT valve position is increased as one measure to prevent the heat exchanger shell warm end from getting too cold. The position of Cold JT valve 16 reaches the constraint, but the control methods still manage to control the shell warm bundle close to its constraint. When the position of Cold JT valve 18 reaches its constraint value, the control methods of this example increase the speed target value from 4550 rpm for the compressor to about 4850 rpm.

Figure 8B:
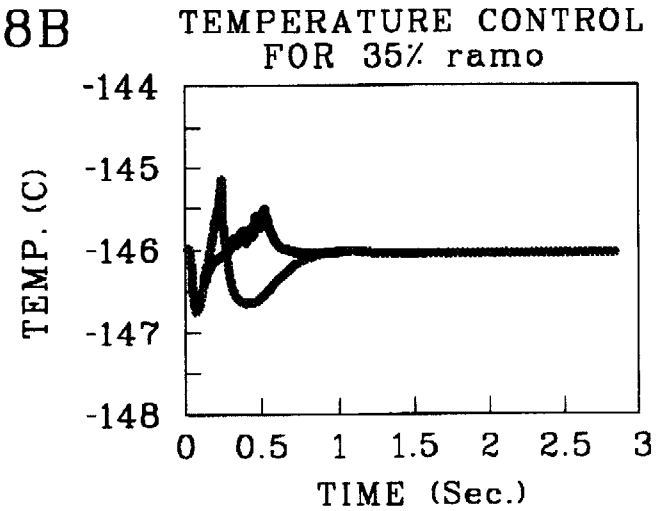
FIG. 8B is a graph illustrating control of LNG temperature versus time for a 35% ramp reduction, at 1% per minute, in LNG flow setpoint scenario.
Figure 8C:
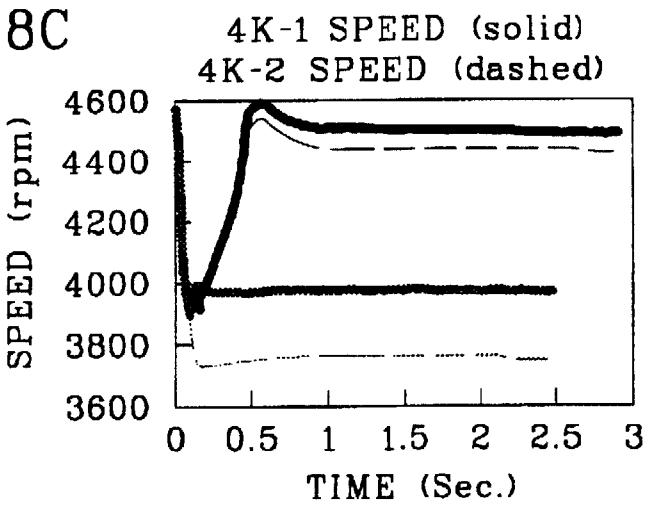
FIG. 8C is a graph illustrating control of low pressure and high pressure compressor speeds versus time for a 35% ramp reduction, at 1% per minute, in LNG flow setpoint scenario.
Figure 8A:
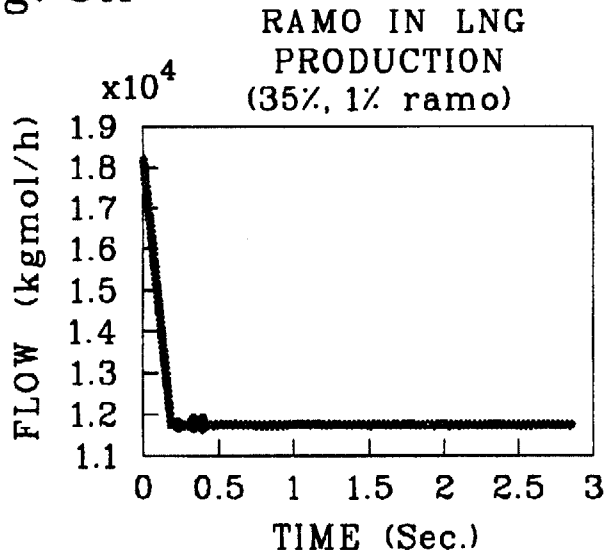
FIG. 8A is a graph illustrating control of LNG flow rate versus time for a 35% ramp reduction, at 1% per minute, in LNG flow setpoint scenario.
Figure 8D:
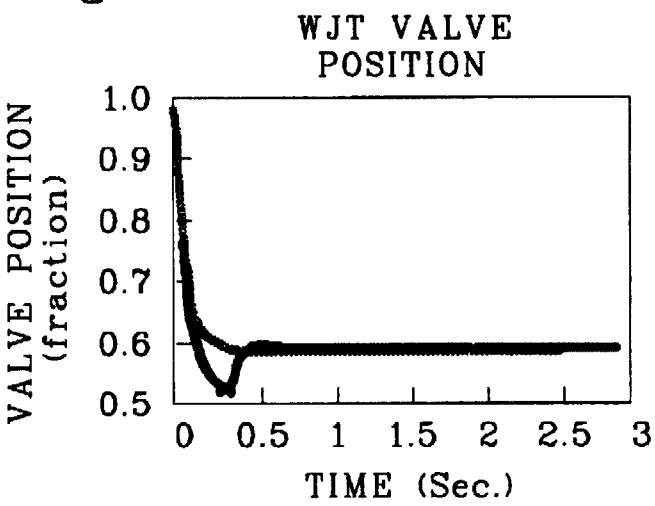
FIG. 8D is a graph illustrating control action by warm JT valve position versus time for a 35% ramp reduction, at 1% per minute, in LNG flow setpoint scenario.
Figure 10:
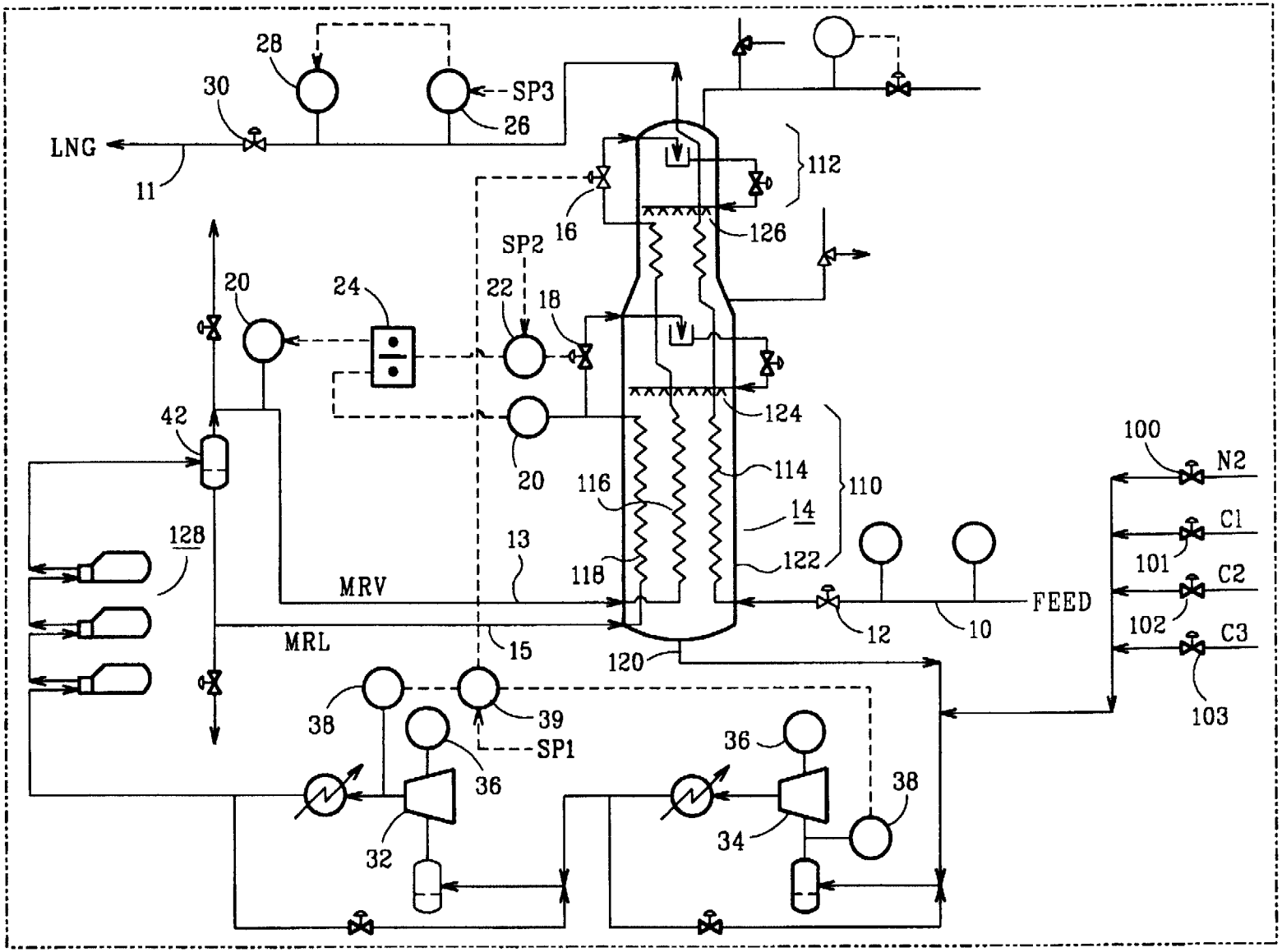
Fig. 10 Prior Art
FIG. 10 is a schematic flow diagram of a typical mixed refrigerant liquefied natural gas plant indicating the placement of sensors for a cascade control system of the prior art.

FIGS. 8A through 8D illustrate the performance of the compressor speed based and recirculation based control methods for a 35% ramp reduction, at 1% per minute, in LNG flow setpoint scenario. FIG. 8A is a graph illustrating control of LNG flow rate versus time, FIG. 8B is a graph illustrating control of LNG temperature versus time, FIG. 8C is a graph illustrating control of low pressure and high pressure compressor speed versus time, and FIG. 8D is a graph illustrating movement of warm JT valve position versus time for a 35% ramp reduction, at 1% per minute, in LNG flow setpoint scenario.

FIGS. 8A through 8D illustrate that control of LNG flow rate and temperature by the exemplary control methods is well within the requirements given in Table 2. FIG. 8C shows compressor speeds for this example, and shows that in the speed-based strategy, once the production flow rate ramp-down is nearly complete, and with the assistance of adjustment of the Warm JT valve position, the compressors return to their original speed. Consequently, the compressors have enough speed operating range for a subsequent ramp-down (or ramp-up) in LNG flow rate. For this exemplary 35% production ramp-down scenario the compressors are nearing compressor surge conditions. For this situation, surge conditions are prevented by opening recycle valves for each compressor once a distance to surge falls below 8%.

Figure 9A:
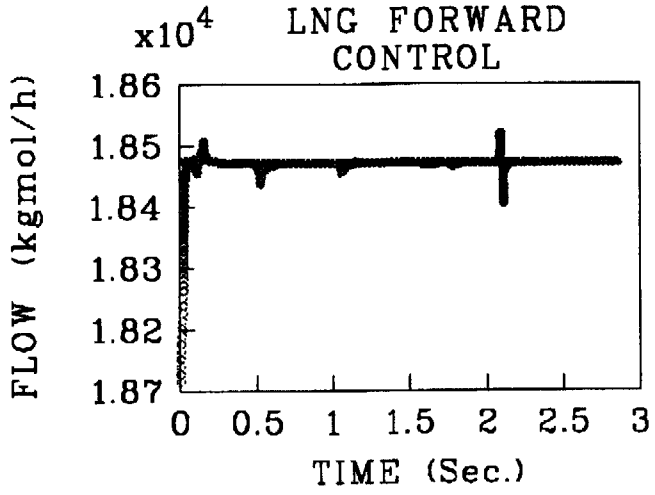
FIG. 9A is a graph illustrating control of LNG flow rate versus time for a servo change and disturbance rejection to maintain setpoints scenario.
Figure 9B:
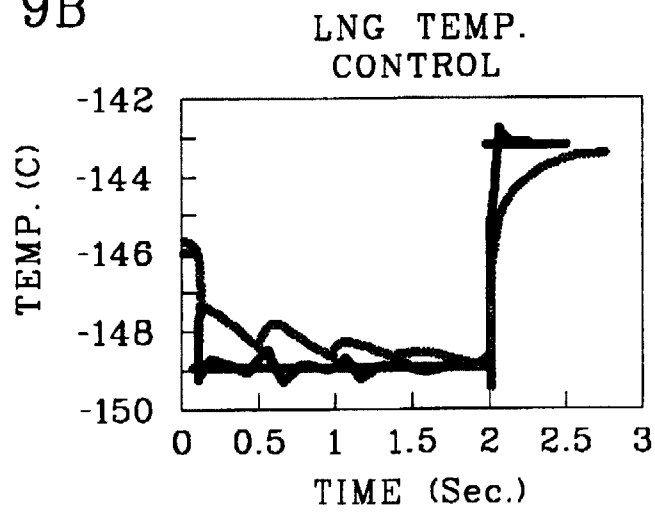
FIG. 9B is a graph illustrating control of LNG temperature versus time for a servo change and disturbance rejection to maintain setpoints scenario.

FIG. 9A is a graph illustrating control of LNG flow rate versus time, and FIG. 9B is a graph illustrating control of LNG temperature versus time, for a servo change and disturbance rejection scenario. As is shown, both the compressor speed-based and recirculation based control methods provide adequate control of LNG flow rate and temperature. For this scenario, the following sequence of events was simulated: at 100 sec., Increase LNG Flow SP+2% (18472); at 1000 sec., Change LNG Temp SP by 2% (colder; −149 degrees centigrade); at 5000 sec., Reduce Feed Pressure by 2%; at 10000 sec. Reduce C1 composition in Feed by 2%; at 15000 sec., Increase MCR temp into HPSEP by 2%; and at 20000 sec., Change LNG Temp SP by 4% (warmer; −143.1 degrees centigrade).

While preferred embodiments of the invention have been shown and described herein, it will be understood that such embodiments are provided by way of example only. Numerous variations, changes, and substitutions will occur to those skilled in the art without departing from the spirit of the invention. Accordingly, it is intended that the appended claims cover all such variations as fall within the spirit and scope of the invention.

What is claimed:

1. A method for controlling the production of a liquefied natural gas (LNG) outlet stream by refrigeration of the natural gas flowing through a liquefaction process, comprising the steps of:

(a) measuring a temperature and a flow rate of the LNG outlet stream; and (b) varying the refrigeration of the natural gas to adjust the temperature value of the LNG outlet stream and independently adjusting the rate of the LNG flowing through the process, thereby to maintain the flow rate of the LNG outlet stream at a predetermined flow value and the temperature at a predetermined temperature value.

2. The method of claim 1, wherein step b) further comprises varying a value associated with a compressor providing the refrigeration, thereby to adjust the temperature value of the LNG outlet stream.

3. The method of claim 2, wherein step b) further comprises the steps of:

providing the refrigeration in a closed loop refrigeration cycle in which a compressor adjusts the flow and pressure of a refrigerant, and varying at least one compressor value selected from the group consisting of speed, guidevane angle and stator blade position of the compressor to adjust the operation of the closed loop refrigeration cycle, thereby to adjust the temperature value of the LNG outlet stream.

4. The method of claim 3, further comprising the steps of:

(c) determining a corresponding target value based on constraints defining an operating range of the compressor for the at least one compressor value; and (d) adjusting the at least one compressor value to the corresponding target value, and (e) varying, based upon the adjustment to the at least one compressor value, at least one value associated with the recirculation of the refrigerant, thereby maintaining the flow value and temperature of the LNG outlet stream.

5. The method of claim 4, wherein step d) varies the at least one refrigerant value based on a feedback signal based on the at least one compressor value and the corresponding target value.

6. The method of claim 1, wherein step b) comprises varying a value of a refrigerant providing the refrigeration, thereby to adjust the temperature value of the LNG outlet stream.

7. The method of claim 6, further including the steps of measuring a refrigerant flow rate and the flow rate of the LNG outlet stream;

forming a ratio of refrigerant flow rate to LNG flow rate; and adjusting the ratio to adjust the operation of the closed loop refrigeration cycle, thereby to adjust the temperature value of the LNG outlet stream.

8. The method of claim 7, wherein the refrigerant is partially condensed to form a refrigerant liquid and a refrigerant vapor and the flow rate measuring step further includes measuring a refrigerant vapor flow rate and a refrigerant liquid flow rate, and the ratio adjusting step further includes adjusting the refrigerant vapor flow to set the refrigerant flow rate and adjusting the refrigerant liquid flow to adjust the ratio until a predetermined flow ratio is achieved.

9. The method of claim 7, wherein the refrigerant is partially condensed to form a refrigerant liquid and a refrigerant vapor and the flow rate measuring step further includes measuring a refrigerant vapor flow rate and a refrigerant liquid flow rate, and the ratio adjusting step further includes adjusting the refrigerant liquid flow to set the refrigerant flow rate and adjusting the refrigerant vapor flow to adjust the ratio until a predetermined flow ratio is achieved.

10. A method for the simultaneous control of the temperature and the flow rate of a liquefied natural gas (LNG) outlet stream from a process for the liquefaction of natural gas by refrigeration of the natural gas, which method comprises:

(a) establishing a predetermined flow rate for the LNG outlet stream;

(b) detecting the actual flow rate of the LNG outlet stream;

(c) adjusting the actual flow rate of the LNG outlet stream to the predetermined flow rate;

(d) establishing a predetermined temperature for the LNG outlet stream (e) detecting the actual temperature of the LNG outlet stream; and (f) controlling the refrigeration provided to the natural gas to adjust the temperature of the LNG outlet stream to the predetermined temperature.

11. The method of claim 10 wherein the refrigeration of the natural gas is provided via indirect heat exchange with a refrigerant in a closed loop refrigeration cycle and the adjustment of the refrigeration is effected by the operation of the closed loop refrigeration cycle.

12. The method of claim 10 wherein a plurality of control devices operate to adjust the flow rate and temperature of the LNG outlet stream so as to achieve the predetermined flow rate and temperature by controlling the refrigeration provided to the natural gas.

13. The method of claim 10 wherein the process for the liquefaction of natural gas in conducted in a plant which comprises a heat exchanger having a warm end and a cold end and a natural gas feed stream inlet at the warm end thereof, a conduit for the cooling and liquefaction of the natural gas by indirect heat exchange with a refrigerant stream contained in a separate refrigeration cycle, and a liquefied natural gas line for transmission of the LNG outlet stream at the cold end of the heat exchanger, said line having an LNG flow control device; which refrigeration cycle comprises a compressor for compressing the refrigerant, a condenser for condensing the compressed refrigerant, an expansion device for expanding the condensed refrigerant and introducing the expanded refrigerant into an evaporation zone in which the expanded refrigerant is indirectly heat exchanged with and provides refrigeration to the natural gas stream, thereby liquefying the natural gas, and means for returning expanded, evaporated refrigerant from the warm end to the compressor; and wherein the control of the refrigeration is effected through feedback control by manipulating a process variable selected from the group consisting of:

operation of the compressor; and operation of the expansion device.

14. The method of claim 13 wherein the condenser functions to condense partially the compressed refrigerant to produce a vapor refrigerant and a liquid refrigerant and there are separate expansion devices for each of the vapor refrigerant and the liquid refrigerant and either or both of the separate expansion devices are separately manipulated.

15. The method of claim 13 wherein the refrigerant compressor is selected from the group consisting of a centrifugal compressor having guidevanes and an axial compressor having stator blades and the flow rate of the LNG outlet stream is subject to feedback control by adjustment of the LNG flow control device and the temperature of the LNG outlet stream is subject to feedback control by adjustment of a compressor variable selected from the group consisting of:

(a) the speed of the refrigerant compressor;

(b) the angle of the guidevanes; and (c) the stator blade angle.

16. The method of claim 15 wherein the compressor variable is the speed of the refrigerant compressor and:

(a) if the temperature of the LNG outlet stream is higher than the predetermined temperature, the speed of the refrigerant compressor is increased; or (b) if the temperature of the LNG outlet stream is lower than the predetermined temperature, the speed of the refrigerant compressor is decreased.

17. The method of claim 15 wherein the compressor is a centrifugal compressor and the compressor variable is the angle of the guide vanes and:

(a) if the temperature of the LNG outlet stream is higher than the predetermined temperature, the angle of the guide vanes is increased; or (b) if the temperature of the LNG outlet stream is lower than the predetermined temperature, the angle of the guide vanes is decreased.

18. The method of claim 15 wherein the compressor is an axial compressor and the compressor variable is the angle of the stator blades and:

(a) if the temperature of the LNG outlet stream is higher than the predetermined temperature, the angle of the stator blades is increased; or (b) if the temperature of the LNG outlet stream is lower than the predetermined temperature, the angle of the stator blades is decreased.

19. The method of claim 15 wherein the flow rate and temperature of the LNG outlet stream are simultaneously controlled by feedback via simultaneous and coordinated adjustment through a multivariable controller of the LNG flow control device and at least one of the compressor variables.

20. The method of claim 19 wherein the compressor variable is the speed of the refrigerant compressor.

21. The method of claim 19 wherein the compressor is a centrifugal compressor and the compressor variable is the angle of the guidevanes.

22. The method of claim 19 wherein the compressor is an axial compressor and the compressor variable is the angle of the stator blades.

23. The method of claim 13 wherein the conduit for the cooling of the natural gas in the heat exchanger passes through at least a warm zone proximate the warm end of the heat exchanger and a cold zone proximate the cold end of the heat exchanger, the evaporation zone in the refrigeration cycle is divided into at least a warm zone and a cold zone corresponding, respectively, to the warm zone and the cold zone through which the conduit passes, with a separate expansion device for introducing condensed refrigerant into each of the warm zone and the cold zone, and wherein the warm zone expansion device controls the flow of at least a portion of the condensed refrigerant to the warm zone and the cold zone expansion device controls the flow of at least a portion of the condensed refrigerant to the cold zone and further including the steps of:

(a) establishing a desired target value for the compressor variable;

(b) determining the current value of such compressor variable;

(c) comparing said desired target value to the current value; and (d) adjusting the warm zone expansion device by means of feedback control based upon the difference and upon the integrated difference between the desired target value and the current value of the compressor variable, so as to achieve a change in the temperature of the LNG outlet stream in the same direction as that achieved by adjustment of the compressor variable, and (e) resetting of the compressor variable back to the desired target value.

24. The method of claim 23 wherein the expansion/flow control devices are JT valves.

25. The method of claim 23 wherein the expansion/flow control devices are turboexpanders.

26. The method of claim 23 wherein the refrigerant is a multicomponent refrigerant which is partially condensed so as to provide a refrigerant liquid and a refrigeration vapor with the refrigerant liquid flowing through the warm zone and the refrigerant vapor flowing through the cold zone and the warm zone and further including the steps of:

(a) predetermining a desired ratio of flow of liquid refrigerant to the flow of vapor refrigerant (b) measuring the current flow rate of the liquid refrigerant;

(c) measuring the current flow rate of the vapor refrigerant;

(d) determining the current ratio of liquid refrigerant flow to vapor refrigerant flow; and (e) controlling the cold zone expansion/flow control to adjust the liquid refrigerant flow to vapor refrigerant flow ratio to the predetermined ratio.

27. The method of claim 23 wherein the expansion/flow control devices are JT valves.

28. The method of claim 23 wherein the expansion/flow control devices are turboexpanders.

29. The method of claim 26 which further includes constraint control of the temperature of the returning refrigerant at the warm end of the heat exchanger:

(a) predetermining a low temperature constraint value for the returning refrigerant at the warm end;

(b) measuring the temperature of the returning refrigerant at the warm end;

(c) comparing the measured temperature to the constraint temperature;

(d) if the measured temperature is less than the constraint temperature, reducing the ratio of the flow rate of liquid refrigerant to the flow rate of vapor refrigerant until the measured temperature becomes greater than the constraint temperature.

30. The method of claim 26 which further includes determining the compressor discharge pressure and the compressor power consumption and further includes constraint control of a process parameter selected from the group consisting of:

(a) compressor discharge pressure;

(b) compressor power consumption;

(c) cold expansion/flow control device; and (d) warm expansion/flow control device;

by altering the desired target value for a compressor variable from the group consisting of:

(a) compressor speed;

(b) guidevane angle; and (c) stator blade angle.

31. The method of claim 30 wherein establishment of the desired target value is effected by means of a steady state optimization calculation utilizing factors selected from the group consisting of:

(a) predetermined LNG outlet stream flow rate;

(b) natural gas feed stream conditions;

(c) quantity of refrigerant in the refrigeration cycle;

(d) composition of the mixed refrigerant;

(e) operating pressures;

(f) available power;

(g) equipment design;

(h) compressor characteristics; and (i) ambient conditions.

32. The method of claim 29 wherein establishment of the desired ratio of the refrigerant liquid flow rate to the refrigerant vapor flow rate is effected by means of a steady state optimization calculation utilizing factors selected from the group consisting of:

(a) predetermined LNG outlet stream flow rate;

(b) natural gas feed stream conditions;

(c) quantity of refrigerant in the refrigeration cycle;

(d) composition of the mixed refrigerant;

(e) operating pressures;

(f) available power;

(g) equipment design;

(h) compressor characteristics; and (i) ambient conditions.

33. The method of claim 26 wherein:

(a) adjustment of the flow rate of the LNG outlet stream is effected by feedback control of the LNG flow control device;

(b) adjustment of the refrigerant liquid flow rate to a predetermined value is effected by feedback control of the warm zone expansion/flow control device;

(c) adjustment of the refrigerant vapor flow rate to a predetermined value is effected by feedback control of the cold zone expansion/flow control device;

(d) a predetermined value for the ratio of refrigerant liquid flow rate to refrigerant vapor flow rate is maintained by adjusting the predetermined value for the refrigerant liquid flow rate;

(e) a predetermined value for the ratio of total refrigerant flow (liquid and vapor) to LNG outlet stream flow rate is attained by adjusting the predetermined value of the refrigerant vapor flow rate; and (f) control of the temperature of the LNG outlet stream is effected by adjustment of the predetermined value of the ratio of total refrigerant flow rate to LNG outlet stream flow rate.

34. The method of claim 33 wherein the speed of the refrigerant compressor is adjusted as a function of mass flow rate through the compressor to attain maximum compressor efficiency.

35. The method of claim 33 wherein the guidevane angles of the refrigerant compressor are adjusted as a function of mass flow rate through the compressor to attain maximum compressor efficiency.

36. The method of claim 33 wherein the stator blade angles of the refrigerant compressor are adjusted as a function of mass flow rate through the compressor to attain maximum compressor efficiency.

37. The method of claim 33 which further includes constraint control of the temperature of the returning refrigerant at the warm end of the heat exchanger comprising the steps of:

(a) predetermining a low temperature constraint value for the returning refrigerant at the warm end;

(b) measuring the temperature of the returning refrigerant at the warm end;

(c) comparing the measured temperature to the constraint temperature;

(d) if the measured temperature is less than the constraint temperature, reducing the ratio of the flow rate of liquid refrigerant to the flow rate of vapor refrigerant until the measured temperature becomes greater than the constraint temperature.

38. The method of claim 33 wherein the refrigerant is a mixed refrigerant composed of a plurality of components having different boiling points.

39. The method of claim 38 wherein the predetermined value for liquid refrigerant flow rate to vapor refrigerant flow rate is determined by means of a steady state optimization calculation utilizing factors selected from the group consisting of:

(a) predetermined LNG outlet stream flow rate;

(b) natural gas feed stream conditions;

(c) quantity of refrigerant in the refrigeration cycle;

(d) composition of the mixed refrigerant;

(e) operating pressures;

(f) available power;

(g) equipment design;

(h) compressor characteristics; and (i) ambient conditions.

40. Apparatus for controlling production of a liquefied natural gas (LNG) outlet stream by refrigeration of the natural gas flowing through a liquefaction process, comprising;

measuring means for measuring a temperature and a flow rate of the LNG outlet stream; and control means for (a) varying the refrigeration of the natural gas to adjust the temperature value of the LNG outlet stream, and (b) independently adjusting the rate of the LNG flowing through the process, thereby to maintain the flow rate of the LNG outlet stream at a predetermined flow value and the temperature and a predetermined temperature value.

41. The apparatus of claim 40, wherein the control means further comprises means for varying a value associated with a compressor providing the refrigeration, thereby to adjust the temperature value of the LNG outlet stream.

42. The apparatus of claim 41, wherein the compressor adjusts the flow and pressure of a refrigerant, and the value associated with the compressor is at least one compressor value selected from the group consisting of speed, guidevane angle and stator blade position of the compressor to adjust the operation of the closed loop refrigeration cycle, thereby to adjust the temperature value of the LNG outlet stream.

43. The apparatus of claim 42, further comprising:

means for determining a corresponding target value based on constraints defining an operating range of the compressor for the at least one compressor value; and means for adjusting the at least one compressor value to the corresponding target value, and the varying means includes means for changing, based upon the adjustment to the at least one compressor value, at least one value associated with the recirculation of the refrigerant, thereby maintaining the flow value and temperature of the LNG outlet stream.

44. The apparatus of claim 40, further comprising means for varying a mixed refrigerant (MR) value of a refrigerant providing the refrigeration, thereby to adjust the temperature value of the LNG outlet stream.

45. The apparatus of claim 44, wherein:

the measuring means further comprises:

a) means for measuring a MR flow rate and the flow rate of the LNG outlet stream, and b) means for forming a ratio of MR flow rate to LNG flow rate; and the control means further comprises: means for adjusting the ratio to adjust the operation of the closed loop refrigeration cycle, thereby to adjust the temperature value of the LNG outlet stream.

46. The apparatus of claim 45, further comprising:

second means for measuring a mixed refrigerant vapor (MRV) flow rate and mixed refrigerant liquid (MRL) flow rate, and means for:

a) adjusting the MRL flow to set the MR flow rate, and b) subsequently adjusting the MRV flow to adjust the ratio until a valve constraint is reached; and means for changing thereafter a value of a compressor providing the refrigeration, thereby to adjust the temperature value of the LNG outlet stream.

* * * * *